US006050242A

United States Patent [19]

Wilkinson

[11] Patent Number: 6,050,242

[45] Date of Patent: Apr. 18, 2000

[54] LOBE SENSOR ARRANGEMENT FOR AN IGNITION SYSTEM

[75] Inventor: Roger Wilkinson, Covina, Calif.

[73] Assignee: Pertronix, Inc., San Dimas, Calif.

[21] Appl. No.: 09/176,149

[22] Filed: Oct. 21, 1998

[51] Int. Cl.[7] ..... F02P 7/07; F02P 7/077

[52] U.S. Cl. ..... 123/406.58; 123/609; 123/617; 324/207.2

[58] Field of Search ..... 123/146.5 A, 406.58, 123/609, 617; 324/207.2

[56] References Cited

U.S. PATENT DOCUMENTS

| | | | |
|---|---|---|---|
| 3,219,878 | 11/1965 | Konopa | 123/617 X |
| 3,923,030 | 12/1975 | Luteran | 123/617 X |
| 4,406,272 | 9/1983 | Kiess et al. | 123/617 |
| 4,473,051 | 9/1984 | Chorman | 123/617 X |
| 4,508,092 | 4/1985 | Kiess et al. | 123/617 |
| 4,518,918 | 5/1985 | Avery | 324/207.2 |
| 4,531,090 | 7/1985 | Hill | 123/617 X |
| 4,901,704 | 2/1990 | Safarnek | 123/617 X |
| 5,028,868 | 7/1991 | Murata et al. | 123/617 X |
| 5,093,717 | 3/1992 | Murata | 123/617 X |
| 5,097,209 | 3/1992 | Santos | 123/617 X |
| 5,126,663 | 6/1992 | Shinjo | 123/617 X |
| 5,127,387 | 7/1992 | Matsuo | 123/617 |
| 5,158,056 | 10/1992 | King | 123/617 X |
| 5,406,926 | 4/1995 | Gu | 123/617 |

*Primary Examiner*—Tony M. Argenbright
*Attorney, Agent, or Firm*—Don Finkelstein

[57] ABSTRACT

A lobe sensor arrangement for an internal combustion ignition system provides a control signal to an ignition coil of the internal combustion engine to effect sequential firing of spark plugs, the ignition system comprising a distributor camshaft having a plurality of alternate circumferentially spaced lobes and valleys. The lobe sensor arrangement includes a pair of sensors spaced from the rotating camshaft and sensing the proximity of the spaced lobes to provide a pair of sensor output signals, and a processor circuit for analyzing the two sensor output signals and generating an ignition control signal upon the occurrence of the sensor output signals having values meeting relative predetermined criteria. One criterion requires that the two output signals be equal in magnitude. Another criterion may require that both output signals have magnitudes above a predetermined threshold. Yet another criterion may set upper and lower thresholds for a signal derived from the difference between the two sensor output signals. Adjusting the physical parameters of the lobe sensor arrangement selectively alters timing and dwell.

33 Claims, 16 Drawing Sheets

LOBE SENSOR ARRANGEMENT FOR AN IGNITION SYSTEM

BACKGROUND OF THE INVENTION

1. Field of the Invention

This invention relates to the field of ignition systems for internal combustion engines, and in particular to an improved lobe sensor arrangement for use in an electronic ignition system for internal combustion engines, the system deriving a signal for initiating the generation of the spark in spark plugs based on the position of the distributor camshaft.

2. Brief Description of the Prior Art

Electronic distributor ignition systems for replacement of point type distributors are well known in the art. Basically, such electronic ignition systems receive their timing information from the distributor camshaft and convert the rotational position of the camshaft into a series of pulses for ultimately creating a spark for distributing to the spark plug in a timed relationship to the rotation of the distributor camshaft. Several electronic ignition systems of the prior art modulate a source of either magnetic or optical flux. A remote sensor monitors the modulated signal. Electronics within the sensor analyzes the modulated signal and transmits a trigger signal for the spark. Synchronization of the modulation source with the position of distributor camshaft insures proper timing of the spark.

The use of Hall-effect devices in electronic ignition systems is also known in the art. In some cases, a single magnet and a single Hall-effect device are spaced apart, and a rotatable object timed with the camshaft passes through the magnetic flux between the magnet and the Hall-effect device, inducing an output from the Hall-effect device. In other arrangements, a pair of magnets with a single Hall-effect device between them, or a pair of Hall-effect devices with a single magnet between them, are employed, but the same technology is relied upon, i.e. producing spark timing pulses by the passing of a rotatable disc-like object, or objects, within the magnetic field, or fields, standing between the magnet(s) and Hall-effect device(s).

One such prior art device can be found in U.S. Pat. No. 5,406,926 to Huan-Lung Gu. This reference shows, in one embodiment, a spark ignition system for an internal combustion engine having a radially extending vane mounted on the distributor rotor shaft and rotates therewith. The vane, at its radially outer end has an axially extending portion which passes by a Hall-effect sensor. The number of axially extending portions is the same as the number of cylinders. The distributor rotor is also mounted on the shaft and is spaced from the vane. An integral part of the apparatus is a stray noise isolating plate (10) extending across the distributor and separating the rotor from the vane. As the shaft rotates, a signal is generated to initiate the spark. Other embodiments have multiple vanes for generating additional signals used for other engine functions. Another embodiment shows a distributorless system with a plurality of coils. There is no distributor rotor, but the top of the unit is closed by the stray noise isolating plate. In some embodiments, the second vane is asymmetrical and provides a signal for fuel injection. While not specifically called out, the structure shown seems to indicate that the axially extending portion passes between the Hall-effect unit and a magnet.

U.S. Pat. No. 5,158,056 to Raymond King shows an ignition system for a spark ignition engine in which a hub is mounted on the camshaft and has a plurality of magnets mounted on the periphery of the hub. A stationary magnetic sensor detects each magnet as it passes during each rotation and generates the signal for the spark ignition.

U.S. Pat. No. 5,127,387 to Haruyuki Matsuo shows a spark ignition signal generator in which a radially extending plate is mounted on a shaft rotated by the engine. At the radially outer end of the plate are tabs bent to be axially oriented. A stationary magnet is positioned in spaced relationship to the Hall-effect unit and the tabs pass between the Hall-effect unit and the magnet on each rotation. The apparatus is directed to the particular shape of the plate.

U.S. Pat. No. 5,126,663 to Izuru Shinjo shows the detailed design for a particular type of mounting for a Hall-effect unit in which a spring type arm provides a resilient force to the plate on which the Hall-effect unit is mounted, and this provides no distortion to the Hall-effect unit.

U.S. Pat. No. 5,097,209 to Alfred J. Santos shows a spark ignition system for an internal combustion engine. A plate is mounted around the shaft of the distributor and extends radially outward. A pair of rings are on the plate, and each has a plurality of magnets in space apart relationship mounted thereon. Hall-effect units are fixed in place and detect the passage of the magnets. Two Hall-effect units are used to detect the outer ring of magnets to provide two signals for each passing magnet. A single Hall-effect unit detects the inner magnets as they pass to provide a single signal. The signals are used to initiate the spark.

U.S. Pat. No. 5,093,617 to Shigemi Murata shows various arrangements of a Hall-effect unit as used in an ignition timing system for internal combustion engines. In the first embodiment, a toothed wheel passes by a front surface of a Hall-effect sensor unit, and the magnet is mounted behind the back surface of the Hall-effect unit. Rotation of the toothed wheel is synchronous with the engine. In all the other embodiments, the toothed wheel passes between the magnet and the Hall-effect unit. The signal generated is used to control engine functions.

U.S. Pat. No. 5,028,868 to Murata et al. shows a flux shutter which is similar to the vane of the aforementioned '926 patent and which passes between the magnet and the Hall-effect unit to generate an engine signal for ignition timing control. In all embodiments, the axial portion of the vane passes between the magnet and the Hall-effect unit. Several different mounting arrangements for the Hall-effect unit and magnet are shown.

U.S. Pat. No. 4,901,704 to Edward J. Safranek reference shows an engine ignition timing structure in which a plurality of magnets are positioned on the outer rim of the flywheel of an engine and rotate therewith. A stator assembly has the coils and four Hall-effect units mounted thereon to sense the passage of the axial portions 6 and 7 of the flux concentrators 29*a* and 29*b* which rotate with the flywheel along with a ring magnet 28 which is spaced from the fixed Hall-effect units. The signal generated by the Hall-effect units is used for ignition timing through a circuitry designed to eliminate the dependency of ignition timing on engine RPM.

U.S. Pat. Nos. 4,508,092 and 4,406,272 to Kiess et al. show a distributorless ignition system in which, in one embodiment, a single Hall-effect unit is positioned between two magnets in a spaced apart relationship radially outward from a rotating shaft. A disc is connected to the crank shaft of the engine for rotation with the shaft, and axially extending flange like members at different radial positions pass through the gaps formed between the magnets and the Hall-effect units. This sequentially generates two signals from the Hall-effect unit, one positive and one negative. These signals are processed through differential amplifiers and Schmidt triggers to a micro processor which utilizes the positive signal for operation of the spark in cylinders 1 and 4 and the negative signal for operation of the spark in cylinders 2 an 3. In a second embodiment, there are provided two Hall-effect units with a spaced magnet between them. The same type of flanges move between the magnet and the Hall-effect units to provide the two output signals. A third embodiment is similar to the first and is linearly arranged for detecting linear motion.

All of the devices and apparatuses of the prior art, in the implementation of an electronic ignition system, have one or more shortcomings. Specifically, prior art devices generally require the provision of an external magnetic force. Prior art devices also create, with such magnets, a magnetic field between the magnet and a Hall-effect device and disturb the magnetic flux between the magnet and the Hall-effect device by a rotating disc-like member which must be specially made and adapted to the internal combustion engine adding cost and requiring time consumption for redesign. That is, the devices of the prior art using Hall-effect sensors do not make use of the lobed camshaft already existing in the distributor of an internal combustion engine.

Furthermore, it is recognized by those skilled in the art that precise timing of an engine is critical to its performance. Using the electronic ignition systems of the prior art, while timing may be precisely set at any point in time, it can vary substantially from the preset condition upon the degradation of components, tolerance of parts, variation of battery power due to discharging and charging cycles, variation of the trigger point in the circuitry receiving the output from the sensor, imprecise threshold detection of analog waveforms having inherently wide range detection windows, and other similar factors.

There is a need in the art for an improved electronic ignition system which may operate directly from, and trigger the spark plug timing from, a standard distributor camshaft having a number of lobes and valleys thereon. There is also a need for an improved electronic ignition system which has more accurate and stable timing and dwell characteristics, substantially independent of aging of parts, power variations, and critical threshold requirements, and which can be readily modified or adjusted to produce timing and dwell parameters applicable to a variety of different engines and/or engine types.

DEFINITIONS

In describing the operation of the invention, certain directional relationships must be explained. The following definitions will assist in understanding the terms used herein.

Camshaft axis is the longitudinal axis of the camshaft of a distributor for an internal combustion engine. The camshaft has radially projecting lobes, and is described herein as rotating clockwise or counterclockwise as the camshaft would be viewed from above, i.e. as it would be observed from the top of the distributor.

Polarity of the back biasing magnet refers to the direction of magnetic flux, i.e. to the North-South orientation of the permanent magnet associated with the Hall-effect devices. A "North" orientation places the North pole of the permanent magnet adjacent the Hall-effect sensors, while a "South" orientation places the South pole of the magnet adjacent the sensors. Since the sensors are always positioned between the back biasing magnet and the camshaft, a "North" orientation of the back biasing magnet results in the magnetic flux lines directed toward the camshaft, while a "South" orientation results in the magnetic flux lines being directed away from the camshaft.

Angle of the Hall-effect sensing elements refers to the angle of the pair of Hall-effect sensing elements relative to the back biasing magnet. For example, even though it is preferable to have the two sensors aligned side-by-side, the back biasing magnet may be set at an angle with respect to the alignment of the two sensors such that one sensor is closer to the magnet than the other sensor, resulting in different output levels from the two sensors for the same motion of a lobe passing by the sensor pair.

Camshaft rotational direction refers to the clockwise or counterclockwise rotational movement of the distributer camshaft as viewed from above, i.e. as it would be observed from the top of the distributor. Dwell time and timing are both affected by the rotational direction of the camshaft for a given sensor and back biasing magnet arrangement.

Timing refers to the time coincidence of a spark generated by the ignition system and the optimum position of a piston as determined by the angular position of the crankshaft of an engine.

Dwell refers to the portion of the timing cycle between spark generations in which current builds up in the primary of the ignition coil.

Sensor offset refers to the lateral displacement of a center line perpendicular to the sensor pair relative to a radial line through the center axis of the camshaft and the peak of the lobe adjacent the sensor pair.

Attitude of the Hall-effect sensing elements refers to the tilt angle, about a line passing through the distributor camshaft axis and the apex of a lobe facing the sensors, of a plane containing the pair of sensors (and magnet) and parallel to the distributor camshaft axis. For a given lobe sensor arrangement configuration, the attitude of the Hall-effect sensing elements may be altered relative to the back biasing magnet as well as the lobes of the distributor cam, if desired.

SUMMARY OF THE INVENTION

The present invention represents a significant technical advancement over the prior art described above by providing a lobe sensor arrangement for producing a trigger pulse in an ignition system which comprises a distributor camshaft having an axis and a plurality of alternate spaced lobes and valleys circumferentially spaced about the axis, each lobe terminating in a narrow apex, the lobe sensor arrangement providing a control signal to an ignition coil of an internal combustion engine to effect sequential firing of spark plugs.

In one aspect of the invention, the lobe sensor arrangement comprises: first and second sensors facing the camshaft, equidistant from the camshaft axis, and spaced equally from respective sides of a plane passing through the camshaft axis; and a pulse generator coupled to the sensors and producing a trigger pulse when each lobe apex is adjacent the sensors and lies in the defined plane.

In another aspect of the invention, there is provided a lobe sensor ignition system for developing a control signal for application to an ignition coil of an internal combustion engine to effect sequential firing of spark plugs, the engine having a distributor camshaft provided with a plurality of alternate circumferentially spaced lobes and valleys, the lobe sensor ignition system comprising: a pair of sensors spaced about the rotating camshaft and sensing the proximity of the spaced lobes to provide a pair of output signals; and a differential amplifier circuit for processing (e.g., comparing or performing a difference function on) the two output signals and generating an ignition control signal upon the occurrence of the processed sensor signals having values meeting relative predetermined criteria.

More particularly, in one variation of the invention, the pair of sensors are arranged to be sequentially passed by the rotating camshaft lobes, making the two output signals from the sensors out of phase relative to one another. A comparator circuit then detects when the two output signals are equal in magnitude, at which time the comparator circuit outputs a signal which is subsequently amplified and opens the current path in the primary of the engine's ignition coil. opening the primary of the ignition coil generates the spark for the spark plugs, as is commonly known.

In addition to determining when the two output signals are equal in magnitude to one another, the present invention may require that both output signals from the pair of sensors be greater than a predetermined threshold value.

Advantageously, since the timing of the triggering of the spark is dependent upon the equating of two signals, in the event of a variation of electrical power, both signals will increase or decrease in magnitude together, and therefore the crossover point, i.e. the point at which the two output signals are equal to generate a spark control signal, will not change from a timing viewpoint.

Moreover, by employing a back biased pair of Hall-effect devices, the sensors are able to be placed extremely close to the ends of the lobes on the camshaft, thereby establishing a high signal-to-noise ratio and developing precise and predictable waveforms for the two sensor outputs for extremely accurate comparison analysis in the differential amplifier.

In yet another aspect of the invention, there is provided a lobe sensor ignition system, employing the aforementioned Hall-effect sensors, for controlling the timing and dwell of an internal combustion engine. This is particularly important, in that there are many shapes and forms of distributor camshafts that otherwise would limit the dwell and timing.

It is to be noted that the dwell period is vital to the performance of all induction ignition systems. It is during this period that current in the primary of the ignition coil increases. The current that is flowing in the primary at the time of the spark and the inductance of the primary are the key parameters that determine the energy available for the spark. The energy available for spark generation determines the available voltage for the spark and the spark duration. Both voltage and spark duration are essential to reliable ignition of the fuel-air mixture. Thus, the importance of the dwell period can be appreciated.

To control timing and dwell, for a given distributor rotational direction: the North/South orientation of the magnetic poles of the back biasing magnet relative to the Hall-effect sensors may be altered; and/or the angular relationship between the back biasing magnet and the sensors may be altered; and/or the orientation of a plane containing the sensors about a line passing through the plane and perpendicular to the camshaft axis may be altered; and/or the symmetry of the sensors relative to a line perpendicular to the camshaft axis and passing through a lobe apex facing the sensors may be altered.

In the description to follow, it will be assumed that the lobe sensing arrangement may be constructed from discrete functional components, or it may include a Hall-effect integrated circuit (HEIC). A preferred HEIC is the dynamic differential Hall-effect integrated circuit, part number TLE 4921, manufactured by Siemens AG, Munich Germany. A technical description of the operation of the Siemens HEIC as a gearwheel tooth speed and position indicator is presented in an article by Klaus Fischer entitled Dynamic differential all-effect ICs measure speed, position and angle in a publication "APPLICATIONS—AUTOMOTIVE ELECTRONICS" (1997) No. 4, such publication being incorporated herein by reference.

BRIEF DESCRIPTION OF THE DRAWING

These and other aspects of the invention will be better understood, and additional features of the invention will be described hereinafter having reference to the accompanying drawings in which.

DETAILED DESCRIPTION OF THE PREFERRED EMBODIMENTS

Figure 1:
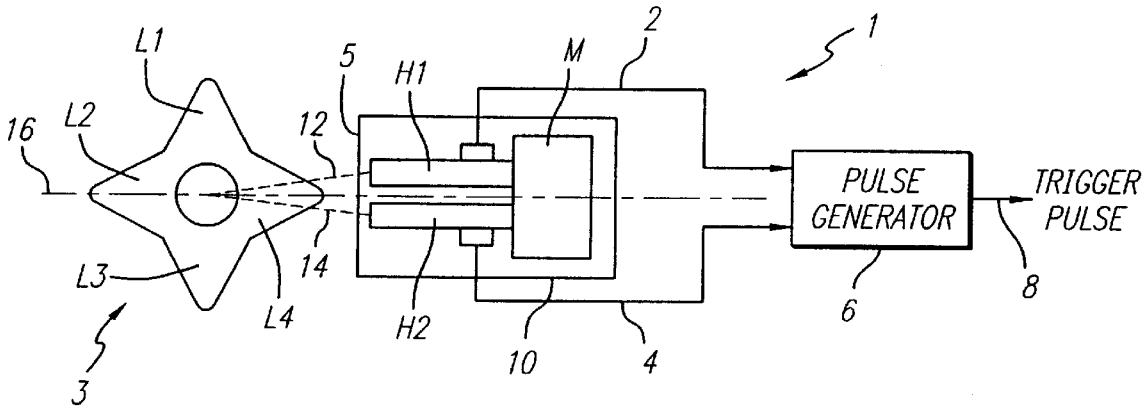
FIG. 1 is a basic block diagram of the lobe sensor arrangement, in accordance with the present invention, for producing a spark generation, or trigger pulse, in an ignition system.

FIG. 1 is a conceptual block diagram of the lobe sensor arrangement 1 configured and adapted to produce an output control signal, or trigger pulse, on line 8 for application to the primary of an ignition coil in an ignition system. That is, the output trigger pulse produced on line 8 represents the timing source for opening and closing the current path in the primary of an ignition coil of an internal combustion engine.

Opening the primary current generates a spark for the spark plugs timed with the rotation of a distributor camshaft 3. The dwell time for the ignition system is defined by the end of the trigger pulse generated by the passing of one of the camshaft lobes L1–L4 and the initiation of another trigger pulse generated by the passing of the next lobe in sequence.

In accordance with the present invention, as distributor camshaft 3 rotates, clockwise as shown in FIG. 1, the lobes L1, L2, L3, and L4 pass by the face of a sensor module 10. Sensor module 10 has a pair of outputs 2 and 4 which are applied to the input of a pulse generator 6. Pulse generator 6 compares the outputs 2 and 4 of the sensor module 10 and produces a trigger signal comprising a series of trigger pulses outputted on line 8 upon the occurrence of the output signals 2 and 4 having values meeting relative predetermined criteria.

In a preferred embodiment, the sensor module 10 is comprised of a pair of Hall-effect devices H1 and H2 back biased by a magnet structure M. Magnet structure M creates a back bias for the Hall-effect sensors H1 and H2, whereby the Hall-effect sensors sense a change in the magnetic flux adjacent the facial surface 5 of sensor module 10 when disturbed by the passing by of a camshaft lobe L1–L4.

Ignoring, for the moment, the effect on the sensor module 10 by lobe L4, lobe L1 is at a sufficient distance from sensor module 10 that it does not contribute to the output signal on line 2 or 4. As camshaft 3 rotates clockwise, lobe L1 approaches the sensing end of Hall-effect sensor H1, disturbing the flux of the magnetic field produced by magnet M and providing a continuously rising analog output signal on line 2. It will be appreciated that when the narrowed apex at the distal end of lobe L1 is at an angular position represented by the dashed line 12, the magnetic disturbance caused by lobe L1 at the Hall-effect sensor device H1 is maximum, and the signal output on line 2 is, likewise, at a maximum level at that position. As lobe L1 passes position 12, the analog output signal level on line 2 begins to drop.

In like manner, when the apex of lobe L1 is at an angular position represented by dashed line 14, the output of Hall-effect sensor device H2 is maximum, and the analog output signal level on line 4 is likewise at a maximum at that position. Again, as lobe L1 continues to move clockwise, past position 14, the output signal on line 4 begins to drop.

As a result, and as a function of time, the sensor output signal on line 2 begins to drop while the sensor output on line 4 is still rising toward its peak. At the precise time when the apex of lobe L1 is exactly centered between the Hall-effect sensor devices H1 and H2, the output signals on signal lines 2 and 4 will be equal. Pulse generator 6 detects this equality in the magnitudes of the signals on lines 2 and 4 and initiates a trigger pulse on line 8 at that instant.

Figure 2:
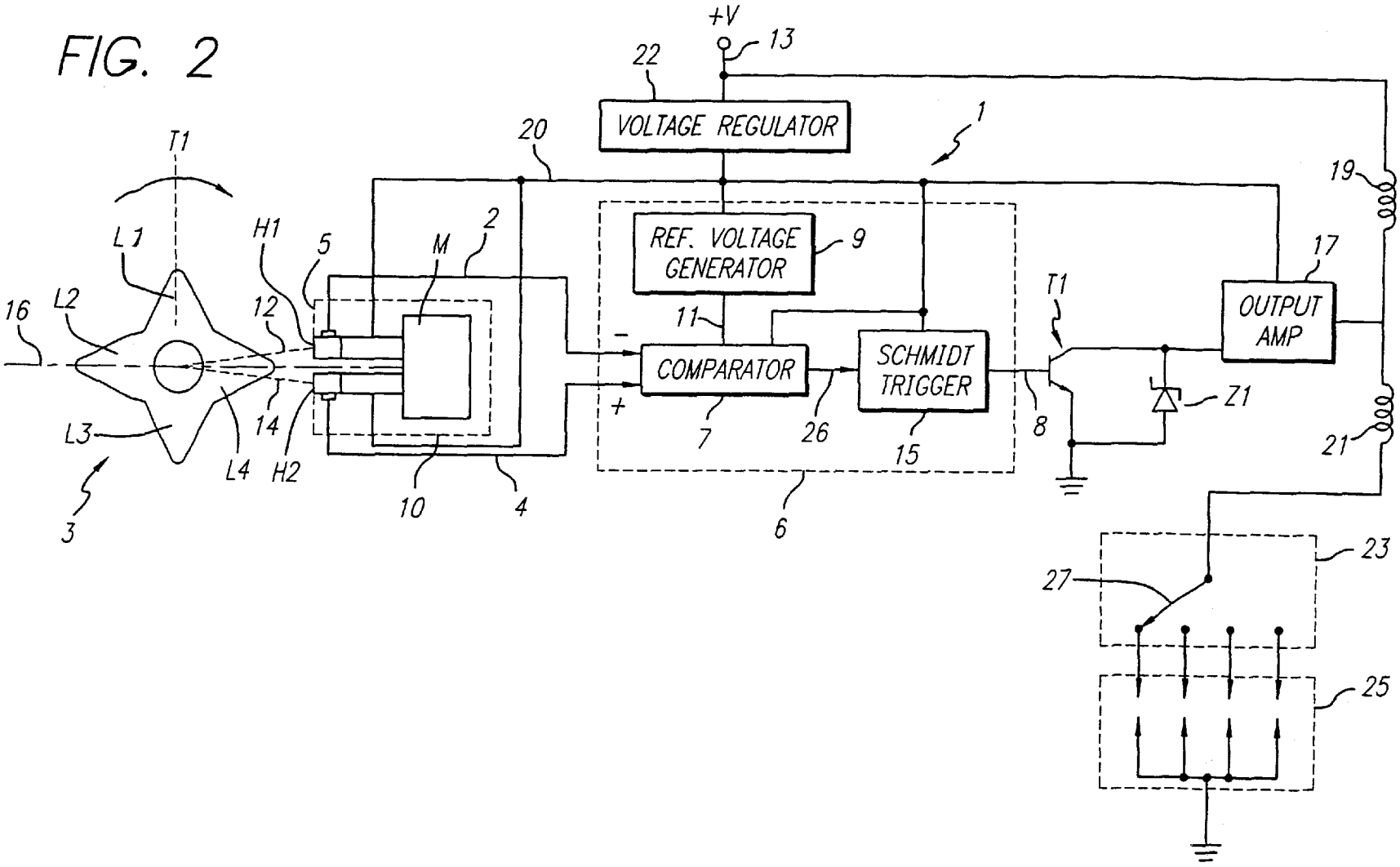
FIG. 2 is a more detailed block diagram showing a complete lobe sensor ignition system constructed in accordance with the present invention.

FIG. 2 is a more detailed block diagram of the electromechanical diagram of FIG. 1, and includes a depiction of the primary and secondary windings 19,21 of the ignition coil as well as the amplifier for interrupting the current in the primary portion 19 of the coil.

The lobe sensor ignition system 1 of FIG. 2 is powered from a power source +V, e.g. the battery voltage 13 for the engine. The battery voltage 13 is applied to a voltage regulator 22 which reduces the battery voltage down to an acceptable constant and regulated voltage level for powering electronic circuitry for the lobe sensor ignition system, while the battery voltage is directly applied to the top of the primary coil 19.

With reference back to the description of the operation of FIG. 1, the Hall-effect sensor module 10 outputs on lines 2 and 4 are routed to a pulse generator 6 comprising a voltage comparator implemented in the preferred embodiment of the invention by a differential amplifier 7. A reference voltage generator 9 supplies a threshold voltage on line 11 to the differential amplifier 7, thereby biasing differential amplifier 7 such that a switching of its output will not occur, even when the two inputs are of equal magnitude, unless the two inputs are both above the threshold voltage. Additionally, for so long as the voltage level on line 2 is greater than that on line 4, differential amplifier 7 will not respond and will not have an output. This would be the condition of the system as a lobe, e.g. lobe L1, is approaching sensor H1 but has not yet reached the plane 16. Plane 16 contains the axis of camshaft 3 and passes between sensors H1 and H2 positioned equally spaced on either side of plane 16.

However, as camshaft 3 continues to rotate, the apex of lobe L1 will eventually lie in plane 16, at which time the apex of lobe L1 is precisely centered between the two sensor devices H1 and H2 such that the sensor outputs on lines 2 and 4 are equal. When the output on line 4 is slightly greater than that on line 2, differential amplifier 7 will switch its output from low to high (or high to low, depending upon the input requirement for Schmidt trigger 15) thereby generating an output pulse on line 26. Schmidt trigger 15, upon receiving an input on line 26 from differential amplifier 7, initiates a trigger output pulse on line 8 duplicative of the pulse on its input but with fast rising and falling edges. The trigger pulse on line 8, during the pulse width of the Schmidt trigger output, turns on transistor T1 to switch output amplifier 17 in a manner to open the current path through primary 19 of the coil for the engine. The instantaneous change in current through the primary 19 generates a high voltage in spark coil (secondary) 21 through inductive coupling. The high voltage spark potential is then applied to the conductive arm 27 of rotor 23 to sequentially distribute the high voltage to the spark plugs 25. The rotor arm 27 is mechanically synchronized with the rotation of camshaft 3 so that when the apex of lobe L1 is precisely in plane 16, a high voltage spark is generated in the corresponding spark plug associated with lobe L1. A zener diode Z1 is connected collector to ground at transistor T1 to clamp the collector at a safe voltage level and prevent an overvoltage spike from damaging transistor T1.

As described above, when the magnitude of the signal on line 4 becomes greater than that on line 2, the differential amplifier 7 will have an output ultimately creating a spark for a spark plug. During the dwell time, i.e. the time between spark generations, there may be noise on signal output lines 2 and 4, or, due to the tolerance of parts values in any circuit arrangement, the quiescent voltage on line 4 may exceed that on line 2 giving a false triggering signal to the Schmidt trigger 15 and ultimately a false high voltage spark to the spark plugs 25. To prevent such a fault condition, the inputs to differential amplifier 7 are biased such that differential amplifier 7 will not respond to signals on either or both of lines 2 and 4 until a prescribed threshold voltage is reached. Since sensor H1 will always lead, in phase, the output of sensor H2 after a prescribed threshold voltage is reached, differential amplifier 7 will continue to remain inactive until the voltage on line 4 exceeds that on line 2.

It is well within the knowledge of any ordinary skilled worker in the field of circuit design to provide a differential amplifier that will not respond to an input on its positive terminal, i.e. from line 4, until the level on the positive input terminal exceeds that on the negative input terminal, i.e. from line 2. Because high gain differential amplifiers are used in common comparator circuits, only a slight input voltage difference between lines 2 and 4 applied to differential amplifier 7 will cause the aforementioned switching action, resulting in an insignificant timing shift in the implementation of a distributer system for internal combustion engines. Accordingly, for all practical purposes, the spark firing time is indeed precisely when output signals 2 and 4 are equal.

Figure 3:
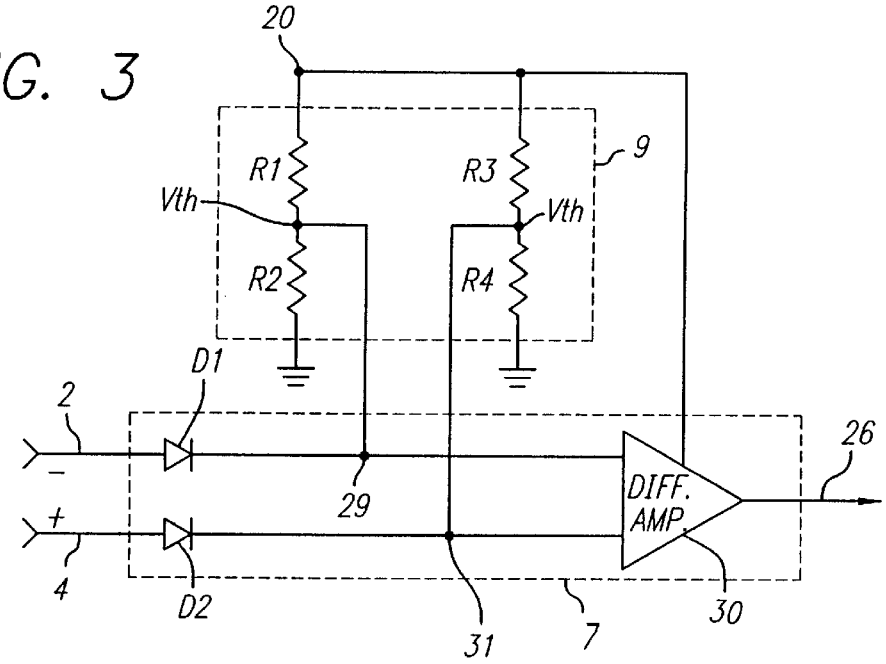
FIG. 3 is a partial schematic of the differential amplifier and reference voltage generator portion of the circuitry shown in FIG. 2.

It is also within the knowledge of the skilled worker to supply a threshold voltage to the inputs of a differential amplifier such that the two inputs both must be above that threshold voltage before the differential amplifier will operate. FIG. 3 shows a simplified circuit which will provide this function, although a variety of other circuit arrangements would suffice. In FIG. 3, a pair of voltage dividers R1, R2 and R3, R4 divide the regulated voltage on line 20 to a specified voltage level referred to in the diagram as Vth. Each resistor divider supplies its threshold voltage Vth to a corresponding input 29, 31 of a high gain differential amplifier 30 in differential amplifier 7. By inserting diodes D1, D2 in series with the inputs 29,31 to differential amplifier 30, each sensor output 2 and 4 must exceed the threshold voltage Vth in order for the corresponding diode D1, D2 to be forward biased and effect the switching action of differential amplifier 30.

Figure 4:
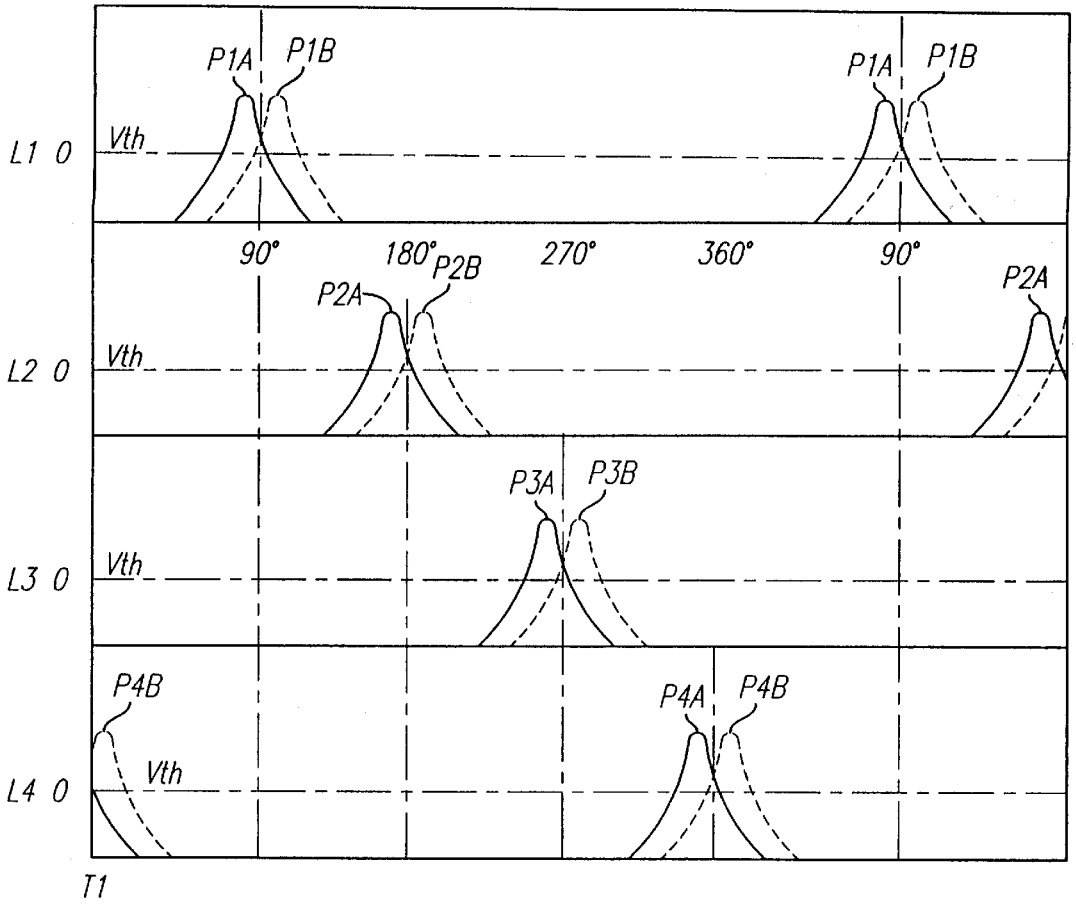
FIG. 4 is a timing chart showing the output waveforms from the pair of Hall-effect sensors for each lobe on a four-lobe distributor camshaft.

FIG. 4 shows the waveforms developed at the outputs of Hall-effect sensor devices H1 and H2 as would be observed on lines 2 and 4 of FIGS. 1 and 2. There are four representations of waveforms in FIG. 4, each showing the two sensor outputs created by each lobe L1–L4 independently. It will be understood that the actual outputs on lines 2 and 4 will be a combination of all four waveforms, and the drawing of FIG. 4 depicts isolated waveforms for each lobe separately for presentation purposes only.

The solid line waveform presentations in FIG. 4 represent the output signal on line 2, i.e. the output of sensor H1, while the dashed line representations indicate the output on line 4, i.e. the output of sensor H2. As will be observed, each output on lines 2 and 4 rises abruptly from a zero level to some peak level and then returns back to zero level as each lobe L1–L4 passes by the sensors. For the output of sensor H1 on line 2 for lobe L1, the output signal rises from a zero level to a peak level P1A which would occur when lobe L1 is at angle 12 (FIGS. 1 and 2). The output of Hall-effect sensor H2 on line 4 lags the output of sensor H1 and has its output rise from a zero level to a peak level P1B which occurs when lobe L1 is at angle 14, and then the output of sensor H2 falls back to zero again.

Similar waveforms, but time shifted, are shown in FIG. 4 for the signal outputs of sensors H1 and H2 as lobes L2–L4 pass by the sensor module 10 arrangement.

In this respect, as shown in FIGS. 1 and 2, the Hall-effect sensor devices H1 and H2 may be mounted in a housing, or module 10, with the faces of the sensors H1 and H2 linearly aligned at a surface 5 of module 10 facing the camshaft 3. The sensors H1 and H2 directly sense the orientation of the distributor camshaft 3 by the detection of the passing of a camshaft lobe L1–L4 adjacent the surface side 5 of module 10, each lobe L1–L4, in sequence, disturbing the magnetic flux produced by the magnet M adjacent surface 5 sufficiently to induce outputs on lines 2 and 4. Thus, the sensors H1 and H2 directly sense the lobes and valleys of the distributor camshaft. When the apex of a lobe of the cam is normal to the surface 5 of the module 10, a spark is generated, as described above. The orientation of the sensing module 10 within the distributor is adjustable (described hereinafter) to insure proper timing and dwell of the spark plug signal. The lobe sensor arrangement will work with an effective air gap, i.e. the gap between the apex of a lobe of the cam and the sensor module 10, of about 0.060". Due to the close proximity of the apex of each lobe as it passes by the sensors H1 and H2, a rather sharp and narrow waveform such as those shown in FIG. 4 is produced.

Returning to the further description of the waveforms in FIG. 4, the waveform plot for the output of sensors H1 and H2 for lobe L1 is shown to start at time T1, indicated in FIG. 2 as the position of lobe L1 radially oriented perpendicular to the plane 16 which contains the axis of camshaft 3 and passes equally between the sensors H1 and H2 in module 10. Thus, the angular representations along the X-axis of the plot for lobe L1 relate to the position of lobe L1 shown in FIG. 2. Since the sensor H1 is above plane 16, and the sensor H2 is below plane 16 (as viewed in FIG. 2), the output of sensor H1 reaches its peak P1A slightly in advance of the 90° rotation angle of lobe L1, while the peak P1B for the output of sensor H2 lies slightly greater than the 90° rotation angle of lobe L1. The two waveforms are thus equal in magnitude at precisely the 90° rotation angle for lobe L1, i.e. when the apex of lobe L1 lies in plane 16, is equidistant from the sensors H1 and H2, and is normal to the front surface 5 of sensor module 10.

With reference to FIGS. 2 and 4, the threshold voltage produced by reference voltage generator 9 is set at a prescribed level less than the peak level of each output signal on lines 2 and 4, defining a window of time where both waveforms from sensors H1 and H2 are above threshold voltage Vth.

Figure 5:
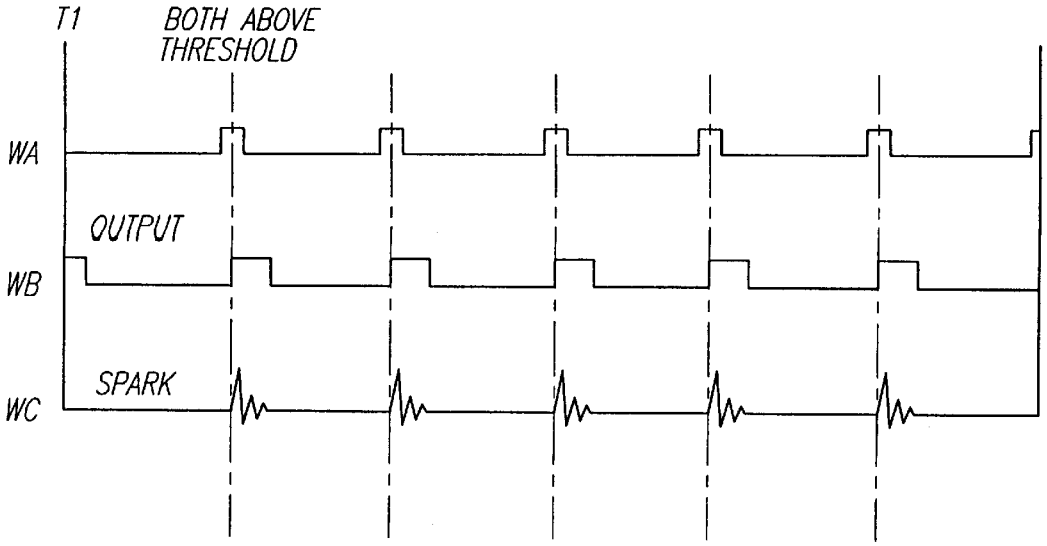
FIG. 5 is a series of waveforms related to those in FIG. 4, showing the development of a sequence of spark generations developed from the comparison of the two output signals from the Hall-effect sensors.

FIG. 5 shows a waveform WA which is not a waveform developed in the circuitry of FIG. 2, but rather simply a window of time representative of when both outputs 2 and 4 are above the threshold level Vth (cf waveform L1 in FIG. 4).

Waveform WB is the output of differential amplifier 30 in differential amplifier 7. As explained above, differential amplifier 7 has its output at a low level until such time as the output on line 4 exceeds the output on line 2 from the Hall-effect device sensors. Relating waveform WB to the timing of the outputs 2 and 4 shown in FIG. 4 for lobe L1, it will be observed that the output of differential amplifier 7 rises to a high level precisely at the crossover point where the falling (or trailing) edge of the output of sensor H1 equals the rising (or leading) edge of the output for sensor H2. This also occurs, by design, precisely at a rotation angle of 90° for lobe L1.

The output of differential amplifier 7 will remain at a high level until the output on line 4 from sensor H2 falls below the output level on line 2 from sensor H1 or until both outputs 2 and 4 fall below Vth. In each case, the return to zero for the output of differential amplifier 7 occurs when the output on line 4 from sensor H2 falls below Vth. The next rise in the output of differential amplifier 7 thus occurs at 180° when the two outputs 2 and 4 from sensors H1 and H2 are equal as lobe L2 passes by the facial surface 5 of sensor module 10. The waveform for lobe L2 is shown to have a peak magnitude P2A preceding the 180° position of lobe L1, and an output from sensor H2 having a peak P2B occurring slightly after the 180° position of lobe L1. Again, the output of differential amplifier 7 falls to the zero level when the output from sensor H2 drops below Vth for lobe L2. This analysis is equally applicable to the waveforms shown in FIG. 4 for the sensor outputs detecting the proximity of lobes L3 and L4.

The output of differential amplifier 7, as seen in FIG. 2 on line 26, is sent to Schmidt trigger 15 which squares up the leading and falling edges of the output pulse on line 26, and therefore has the same pulse width and timing as waveform WB in FIG. 5. The output levels from sensors H1 and H2, and the sensitivity and threshold levels of differential amplifier 7 are determined by the maximum time necessary to insure full collapsing of the magnetic field about primary 19 so as to create a full energy transforming to high voltage ignition coil 21. Otherwise, the pulse width of waveform WB is not critical, for so long as there is sufficient, but not excessive, dwell time between outputs of Schmidt trigger 15.

The output from Schmidt trigger 15 on line 8 is applied to the base of transistor T1 which is turned on for the duration of waveform WB, and this triggers the output amplifier 17 to open coil 19 and create the spark for the spark plugs 25. Waveform WC shows a representation of the series of sparks produced relative to the timing of the rotation of camshaft 3 as referenced to the position of lobes L1–L4 in FIG. 4.

As mentioned previously, the threshold voltage Vth serves the purpose of insuring that noise and tolerance factors of the system do not inadvertently cause the output on line 4 to be greater than that on line 2 and thereby give a false output of differential amplifier 7. As will now be appreciated, Vth is also a significant factor in setting the pulse width of the output signal from differential amplifier 7 as shown by waveform WB in FIG. 5. This waveform WB shows that the output of differential amplifier 7 present on line 26 (and likewise the output of Schmidt trigger 15), has less than a 50% duty cycle, as is desirable in some internal combustion engine ignition systems. It will be understood that the duty cycles and the dwell periods varies depending upon the particular engine and the particular application. Thus, for example, the duty cycle may be greater or less than 50%. If the number of lobes for the camshaft 3 is increased, i.e. if the engine has more than four cylinders, the rising edges of the output of differential amplifier 7 would occur closer to the falling edges, reducing the duty cycle. In order to insure a 50% or less duty cycle for engines with a larger number of cylinders, one solution is to raise the level of Vth. This will reduce the positive going pulse width of waveform WB.

Accordingly, the lobe sensor ignition system of the present invention will operate over the full engine RPM range of zero to 12,000. It provides an optimum duty cycle for all engine sizes (from one to twelve cylinders). This means that the dwell period can be adjusted to produce a consistent predetermined duty cycle for all RPMs and for all cylinder arrangements.

Figure 6:
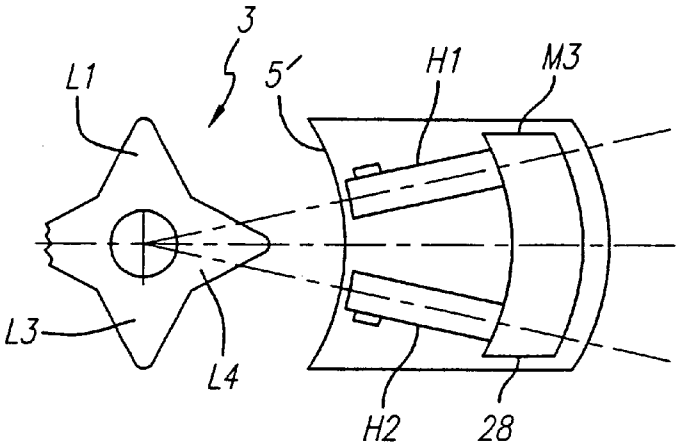
FIG. 6 shows an alternative curvilinear arrangement for the Hall-effect sensors.

FIGS. 1 and 2 show a sensor module 10 having the sensors H1 and H2 aligned in a linear array adjacent the forward facing surface 5 of housing or module 10. To improve the signal-to-noise ratio and provide a stronger output signal for sensors H1 and H2, the sensors H1 and H2 may be arranged along a curvilinear facial surface 5' of a module 28 as shown in FIG. 6. This arrangement places the sensing end of each sensor H1, H2 as close to the rotating apex of each lobe as is possible. A curved magnet M3 may also be formed to provide the required back bias for sensors H1 and H2 of the curvilinear arrangement shown in FIG. 6.

To this point, a symmetrical physical layout for the components of the ignition system has been assumed. As will be evident from the description of FIGS. 8A,B through 19A,B, the symmetry may be purposely altered to provide preferred settings for timing and dwell.

Figure 7:
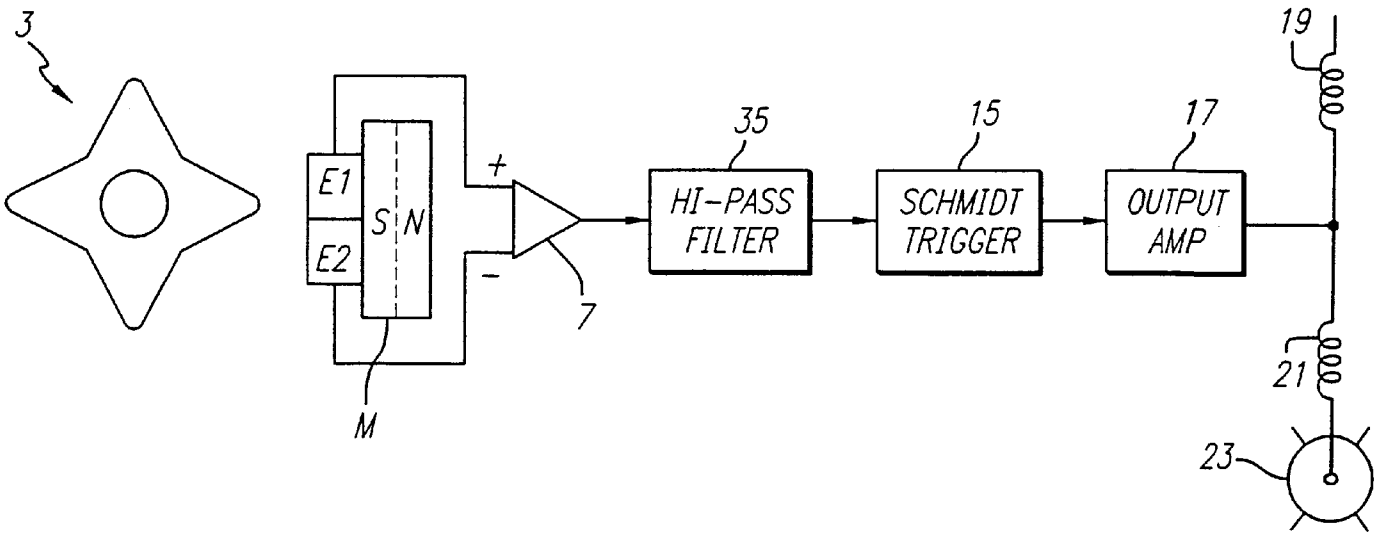
FIG. 7 shows a basic, simplified, schematic diagram of a lobe sensor ignition system employing the principles of the present invention and used as a bases for describing the remaining figures.

In the remaining figures to be described, FIGS. 7–19B, a basic lobe sensor ignition system employing the lobe sensor arrangement according to the present invention will be assumed. Such a basic system is shown in FIG. 7 which comprises two Hall-effect elements E1 and E2, a back biasing magnet M having North and South poles, a differential amplifier 7, a high pass filter 35, and an output amplifier 17 which may include at its input a Schmidt trigger 15. The back biasing magnet M distributes magnetic flux through the two Hall-effect elements E1,E2. The Hall-effect elements E1,E2 are mounted a short distance apart on a common plane. Voltage out of each Hall-effect element is proportional to the magnetic flux flowing through the element.

As a ferromagnetic material (camshaft lobe) approaches the front of a Hall-effect element, the magnetic flux passing through the element changes, and the output voltage changes. In FIGS. 8A–19B, the output waveforms from the Hall-effect elements E1 and E2 are likewise labeled in the waveform charts as E1 and E2. As the lobes of a distributor camshaft, rotate past the two Hall-effect elements E1,E2, a differential circuit 7 processes the two sensor output signals, performing a difference function.

A high pass filter removes the offset (DC component) from the amplified difference signal. The Schmidt trigger 15, with preset operate and release thresholds, receives the filtered signal and provides an output signal synchronized to the rotation of the lobes on camshaft. The output amplifier circuit 17 amplifies this signal for directly controlling the current in the primary winding 19 of the ignition coil 19, 21.

As further explanation as to the timing shown in the waveforms associated with FIGS. 8A–19B, the input threshold points at the input to the Schmidt trigger 15 are referred to as the operate level and release level. These two levels are identified in the waveform diagrams, respectively, as OP and REL. The OP threshold level is shown to be higher than a reference level, and the REL threshold level is shown to be a lower level than the reference level, the reference level labeled REF in the waveform figures and is preferably, but not limited to, a zero volt level.

The Schmidt trigger 15 has an output which goes high when the difference signal E1–E2 from differential amplifier 7 falls below the REL threshold. The output of Schmidt trigger 15 goes from a high level to a low level upon the difference signal E1–E2 exceeding the upper OP threshold level. Output amplifier 17 amplifies the Schmidt trigger output, the waveforms labeled "OUTPUT" in FIGS. 8B–19B therefore representing the timing and general shape of the signal out of output amplifier 17 as well as out of Schmidt trigger 15. Practically, the output amplifier 17 closes and opens the current path through ignition primary coil 19. However, the "OUTPUT" waveforms in the figures are nevertheless shown schematically as rectangular waveforms for ease of presentation and description.

Accordingly, the rising edges of the "OUTPUT" waveforms in FIGS. 8B–19B represent the times the current passing through ignition coil primary 19 ceases and the time at which a spark is generated, while the falling edges of the "OUTPUT" signals represent the time at which current in the ignition primary coil 19 begins to increase and the beginning of dwell.

As a basis for comparison in the description of remaining figures, a brief summary of what will be described follows.

FIGS. 8–11 show the effects of polarity and rotational direction on dwell. For a given rotation, reversing the polarity of the back biasing magnet significantly changes the dwell.

FIGS. 11, 13, 15, and 16 illustrate how α, the angle between the plane of the magnet and the plane of the sensors, affects the dwell and timing. As shown, increasing α will either increase or decrease the dwell, depending on the direction of rotation.

FIGS. 14, 17, and 18 show the effects of offsetting the center of the sensor relative to the radial line through the center of the camshaft.

Figure 19A:
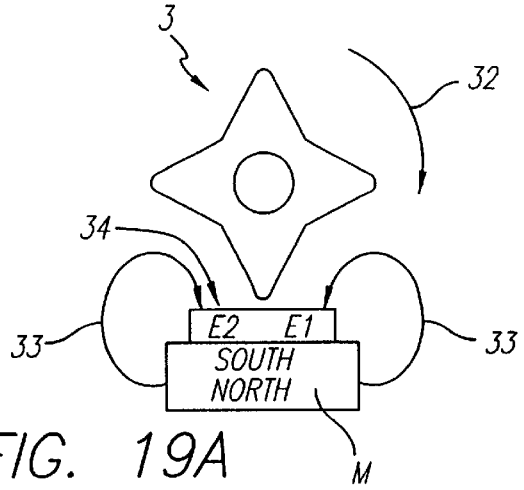
FIGS. 19A, 19B and 19C are similar to FIGS. 10A and 10B, except that the plane containing the sensors is tilted about a line passing perpendicularly through the distributor camshaft axis and the apex of the lobe facing the sensors, the waveforms showing different angular attitudes of the Hall-effect sensing element.
Figure 19C:
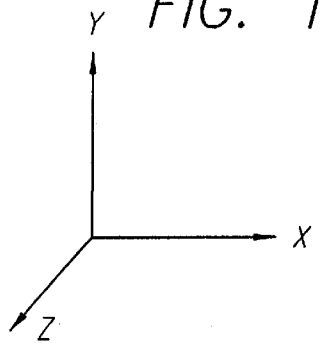

FIG. 19 clarifies the effects of rotating the plane of the sensor and magnet assembly about a line normal to the sensor surface and passing through the axis of the camshaft. Rotating the sensor and magnet assembly 180° changes the dwell phasing by 180°. The dwell period is controllable by setting the rotation of the sensor and magnet assembly, while timing is only slightly affected.

Figure 8A:
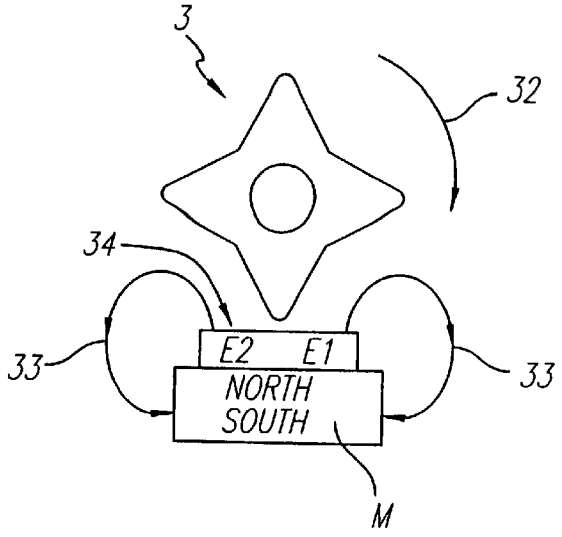
FIGS. 8A and 8B show, respectively, schematic representations of a lobe sensor arrangement and the waveforms resulting from such arrangement.
Figure 8B:
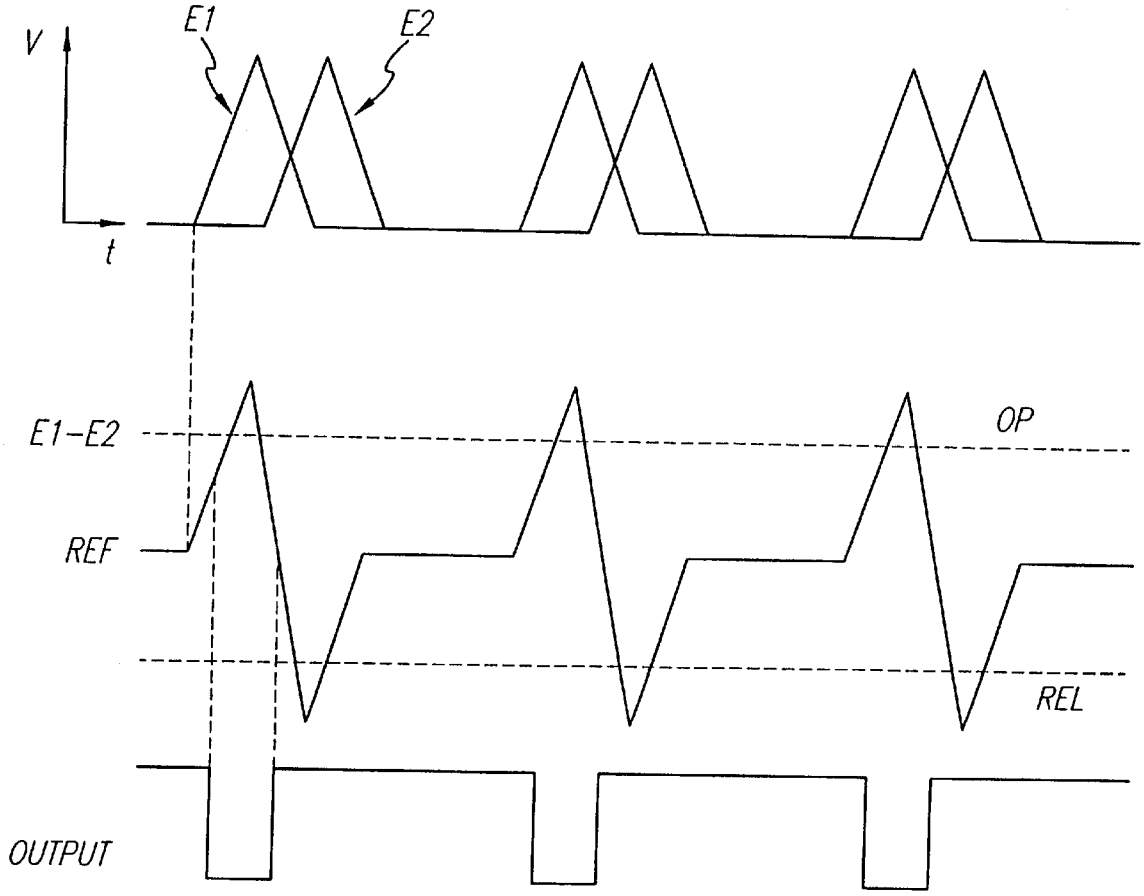

Turning now to FIGS. 8A and 8B, for a given rotational direction, indicated by arrow 32, of the distributor camshaft 3, and the North-South orientation of back biasing magnet M which defines magnetic lines of force extending in a direction of flux field lines 33, and the placement of the Hall-effect sensor pair E1 and E2, as shown, an output is generated. The sensor outputs E1 and E2 are as shown at the top of the voltage versus time waveforms of FIG. 8B. Recalling the time relationship between the outputs of the two sensors (as described with reference to FIG. 4), it will be observed that the outputs from E1 and E2 are of equal amplitude with the E2 output delayed somewhat from the E1 output.

The effect of differential amplifier 7 is to invert the output from sensor E2 and sum this inverted signal with the non-inverted signal from sensor E1, the result being a difference signal referred to in FIG. 8B as waveform E1–E2. After this difference signal, E1–E2, passes through high-pass filter 35 to remove any DC component of the difference signal, it will be observed that the difference waveform is symmetrical about a reference level REF (which may be zero volts) with portions of the positive going part of the waveform E1–E2 exceeding the operate threshold OP of the Schmidt trigger 15, and with negative going portions falling below the lower release threshold REL.

The lower waveform of FIG. 8B shows that the output of Schmidt trigger 15 and output amplifier 17 is high until the operate threshold OP is reached, at which time it drops to a low level and remains there until the release threshold REL is reached by the negative going part of the difference signal E1–E2. The distance between the crossing of the operate threshold OP and the release threshold REL defines the width of the output at the lower level thereof. It will be appreciated that the current flow through primary coil 19 is interrupted during the time the output shown in FIG. 8B is at the higher level. The physical parameters of the arrangement shown in FIG. 8A are selected to produce a predetermined width for the higher and lower levels of output to allow full generation of the spark for the engine, together with adequate dwell.

When the output from amplifier 17 in FIG. 8B goes to a low level, this causes current to again build in primary coil winding 19 from the battery source +V, i.e. during the dwell time—the duration of the low level of the output shown in FIG. 8B.

It will be understood that the polarity of the signal identified as "OUTPUT" in FIG. 8B, and FIGS. 9B–18B, may be inverted, if desired, depending upon the electrical parameters of the engine in which the lobe sensor arrangement is placed. Thus, the waveform indicated as "OUTPUT" in FIG. 8B and in FIGS. 9B–18B represent possible timing relationships as well as dwell and spark generation time periods, and it is well within the skill of the average worker to invert, or not, the "OUTPUT" signal for the particular application at hand.

Figure 9A:
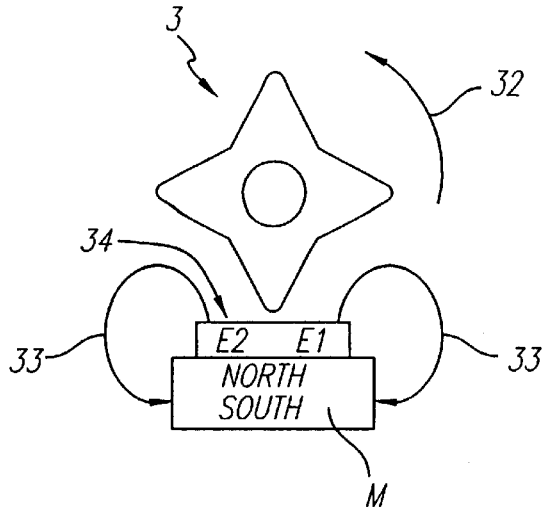
FIGS. 9A and 9B are similar to FIGS. 8A and 8B except that the camshaft rotates in the opposite direction.
Figure 9B:
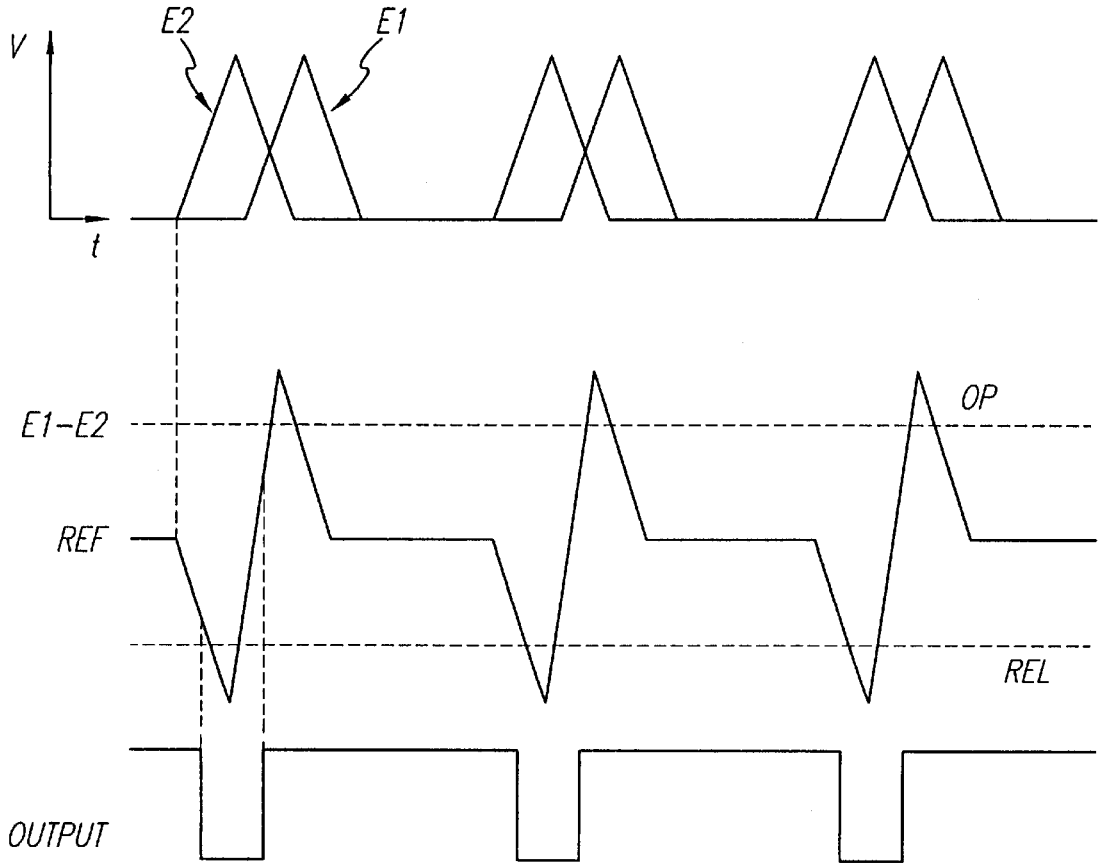

FIGS. 9A and 9B are similar to FIGS. 8A and 8B except that the camshaft rotates in the opposite direction. Reversing the direction of rotation of the distributor camshaft 3 essentially swaps the E1 and E2 waveforms. By the analysis previously given with respect to FIGS. 8A and 8B, it will be observed that the only difference in the output is that it is essentially an inverted signal from the output shown in FIG. 8B. Since the lobe sensor arrangement of FIG. 9A is obviously inserted in a different engine than that of FIG. 8A, due to the reverse rotation of the distributor camshaft, FIGS. 9A and 9B simply indicate that, for an engine having a counterclockwise rotation for the distributor camshaft, an appropriate output pulse having predetermined dwell and spark generation time periods can be easily accommodated.

Figure 10A:
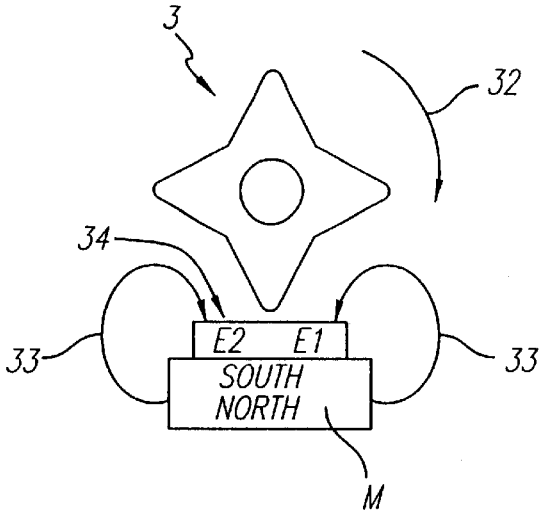
FIGS. 10A and 10B are similar to FIGS. 8A and 8B, except that the polarity of the magnetic field is reversed.
Figure 10B:
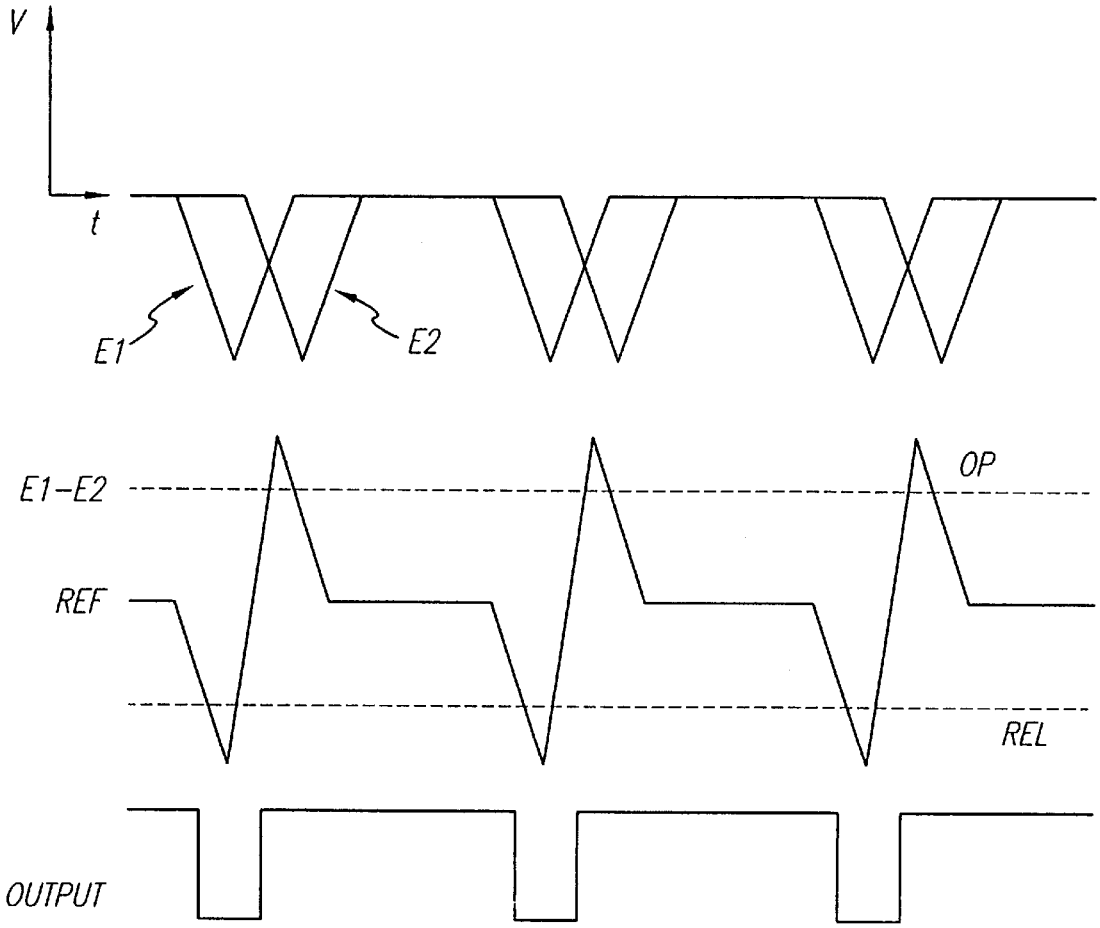

FIGS. 10A and 10B are similar to FIGS. 8A and 8B, except that the polarity of the magnetic field is reversed. Because the magnetic field direction is reversed in FIG. 10A, the E1 and E2 waveforms are both negative going pulses. However, the mathematical difference between these two signals produces an output similar to that shown in FIG. 9B, insofar as the dwell time period is concerned.

Figure 11A:
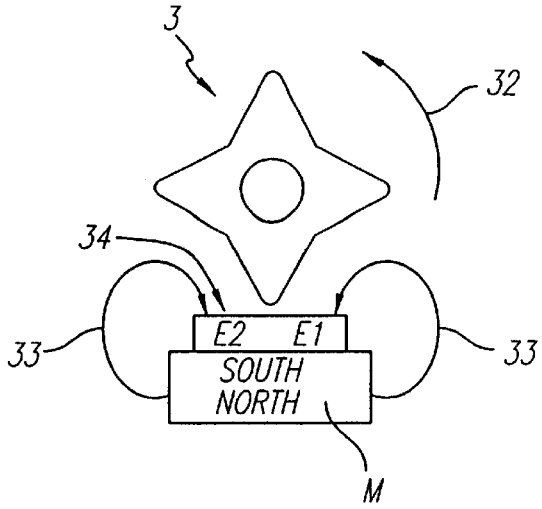
FIGS. 11A and 11B are similar to FIGS. 9A and 9B, except that the polarity of the magnetic field is reversed.
Figure 11B:
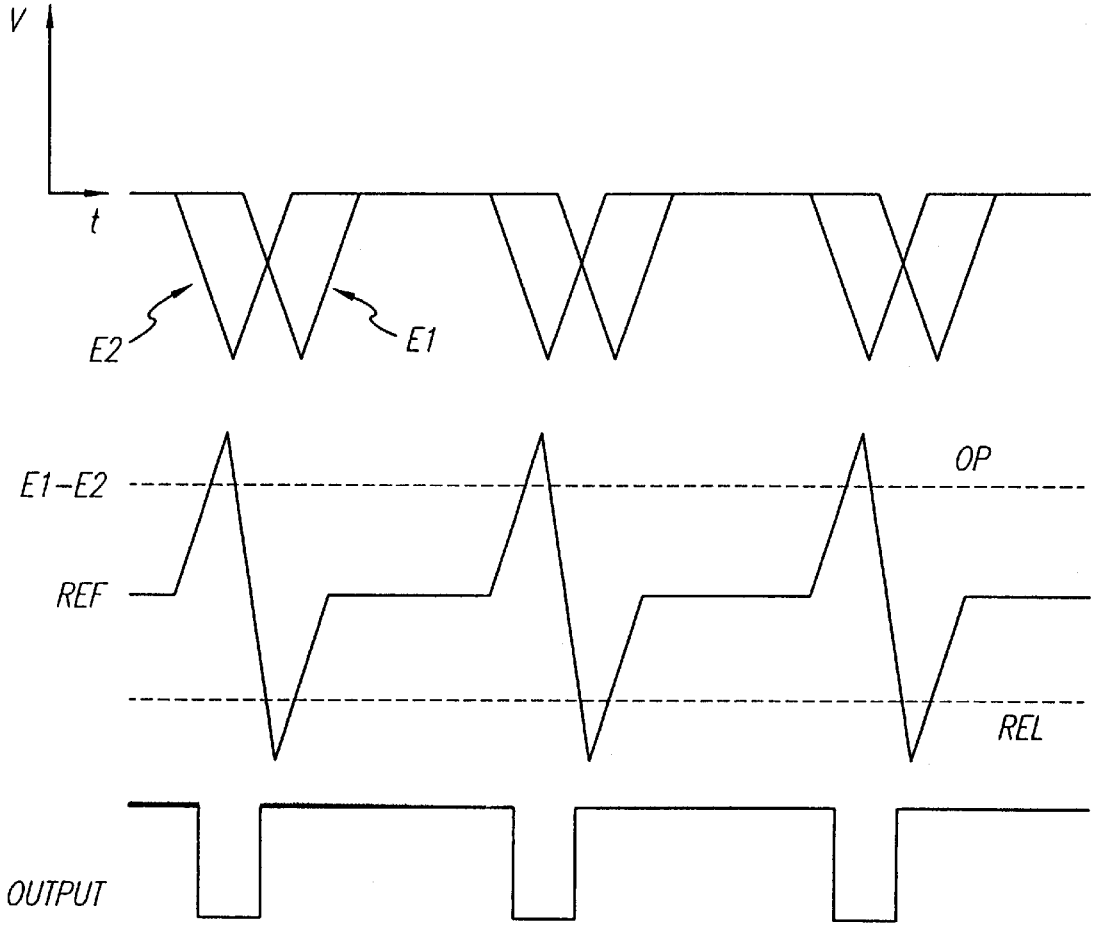

FIGS. 11A and 11B are similar to FIGS. 9A and 9B, except that the polarity of the magnetic field is reversed. Again, due to the direction of the magnetic field line 33, the sensor outputs E1 and E2 are negative going. However, in FIG. 11B, it will be noted that, as contrasted with the waveforms of FIG. 10B, the output of sensor E2 precedes the output of sensor E1, as indicated. The difference signal E1–E2 is thus similar to that shown in FIG. 8B, and the output waveform is also similar to that of FIG. 8B.

Figure 12A:
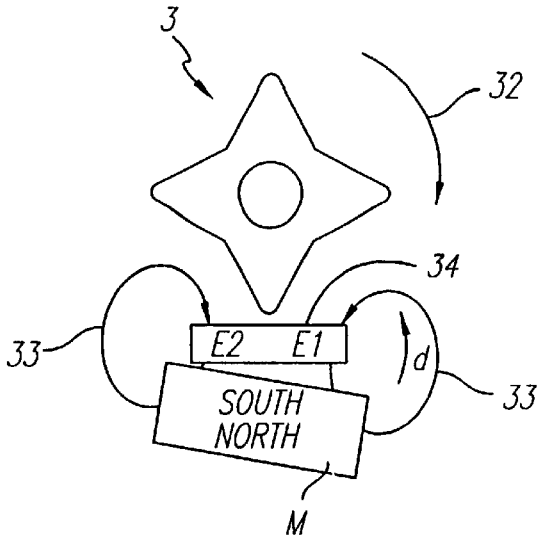
FIGS. 12A and 12B are similar to FIGS. 10A and 10B, except that the back biasing magnet is at an angle relative to the surface of the sensors.
Figure 12B:
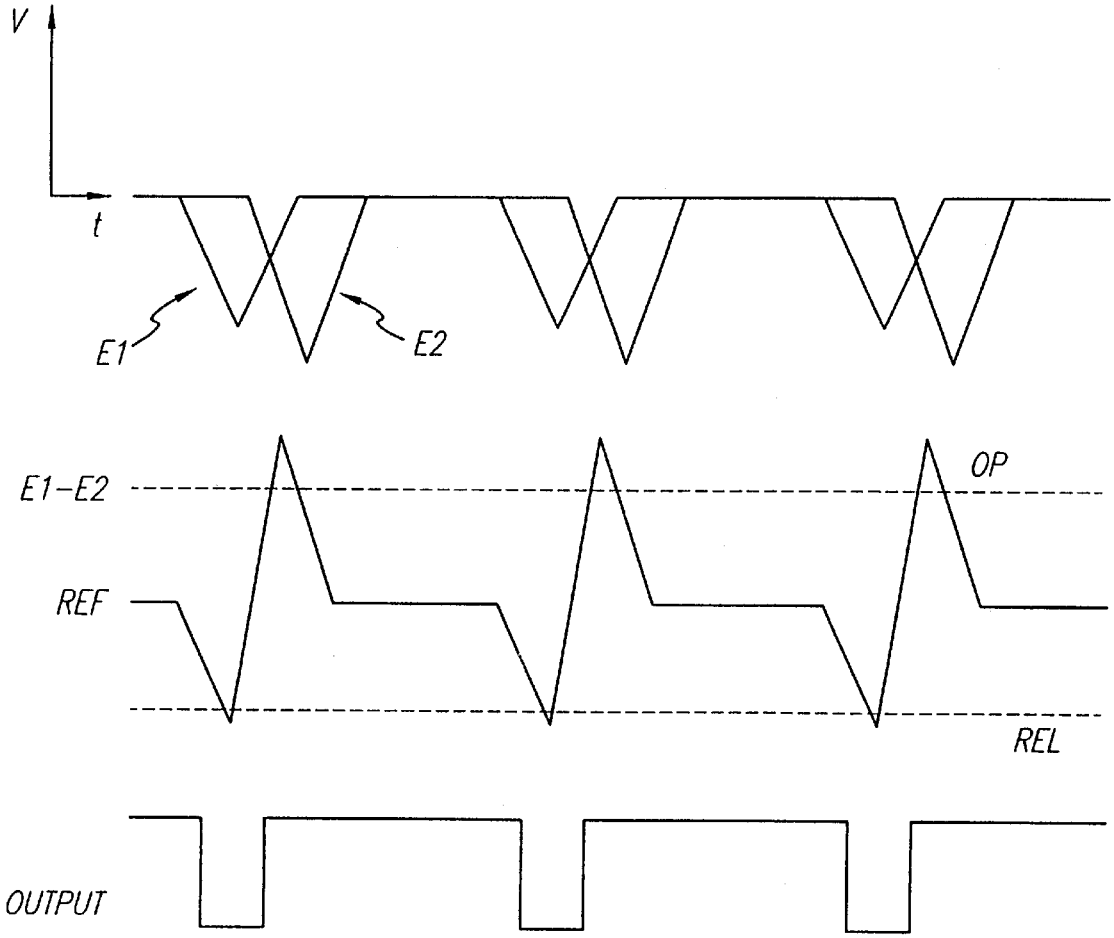

FIGS. 12A and 12B are similar to FIGS. 10A and 10B, except that the back biasing magnet is at an angle a relative to the facial surface of the sensors E1 and E2. Since the sensor E1 is further from the magnet M than the sensor E2, the strength of the magnet field for sensor E1 is less than that for sensor E2, and the output voltage of the sensor E1 is weaker as evidenced by the smaller amplitude of the negative going output from sensor E1 in the top waveform shown in FIG. 12B. As the position of magnet M gets further away from sensor E1, the point of crossing the lower release threshold level moves to the right, timewise. Thus, the beginning of the output pulse, due to the lower amplitude of the E1 output signal, is somewhat delayed, while the falling edge of the output signal is not delayed, resulting in a narrower output pulse for the generation of the spark. It is evident, from this analysis, that the timing of the spark is shifted due to the rotation of the magnet M by an angle α, and the dwell time period is increased.

Figure 13A:
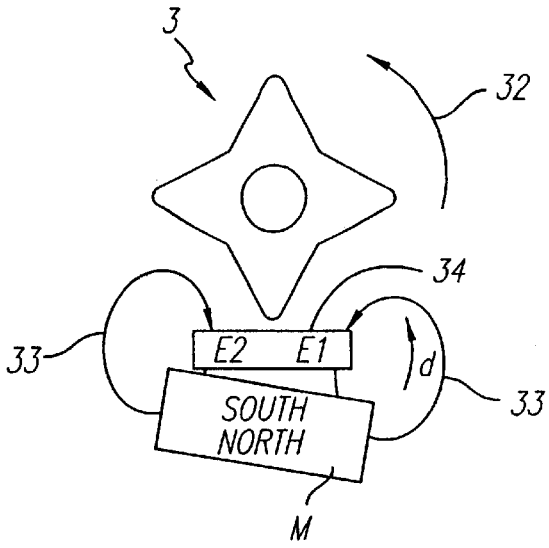
FIGS. 13A and 13B are similar to FIGS. 12A and 12B, except that the direction of rotation of the camshaft is reversed.
Figure 13B:
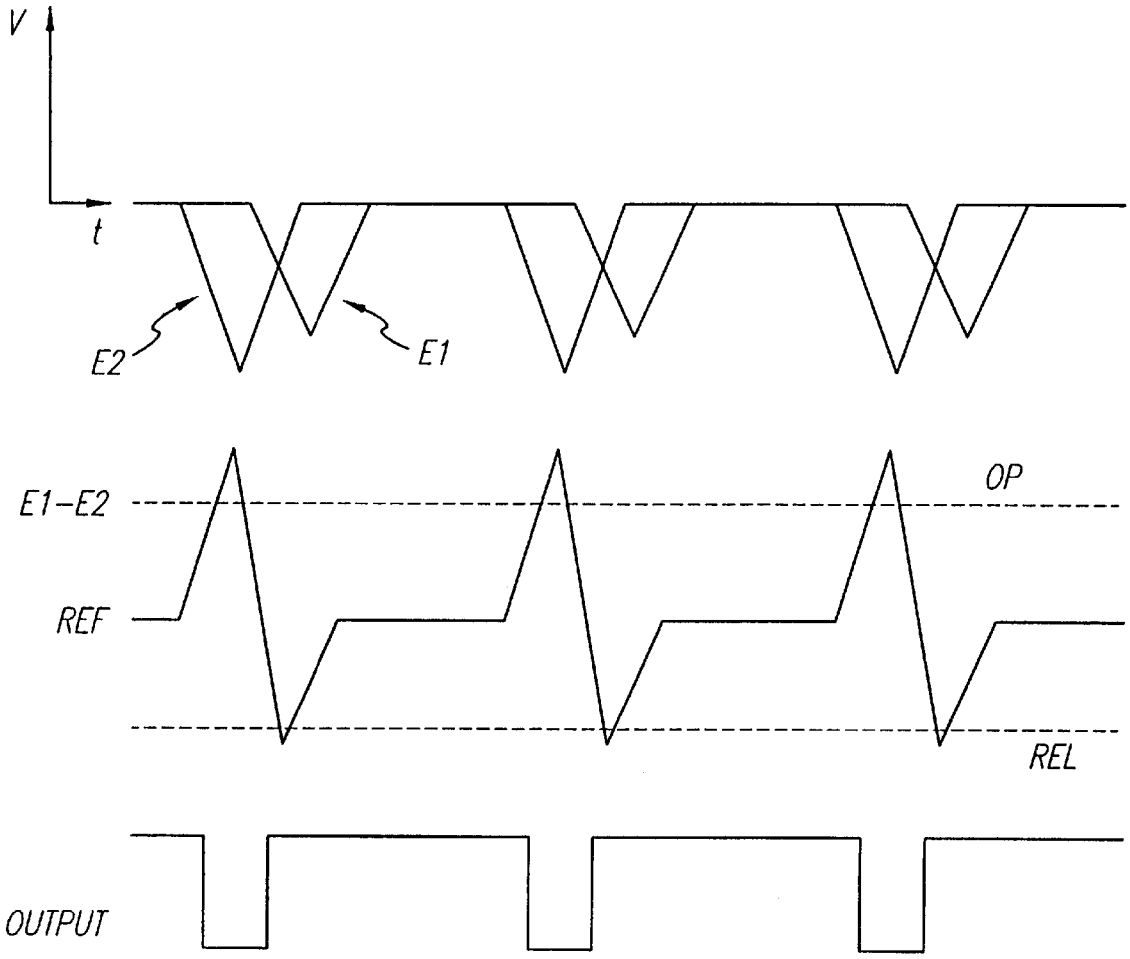

FIGS. 13A and 13B are similar to FIGS. 12A and 12B, except that the direction of rotation of the camshaft is reversed. Due to the reverse direction of the camshaft 3, the lower amplitude E1 output pulse follows the generation of the stronger E2 output pulse. This causes the rising edge of the output pulse to be delayed, and since the falling edge of the output pulse is not delayed, the width of the negative going output pulse (and thus dwell time) is wider than if the angle $\alpha$ was 0 degrees. Again, if desired, this output pulse could be inverted prior to application to the ignition coil primary 19, thus providing an output similar to that shown in FIG. 12B, except that the dwell time is shorter.

Figure 14A:
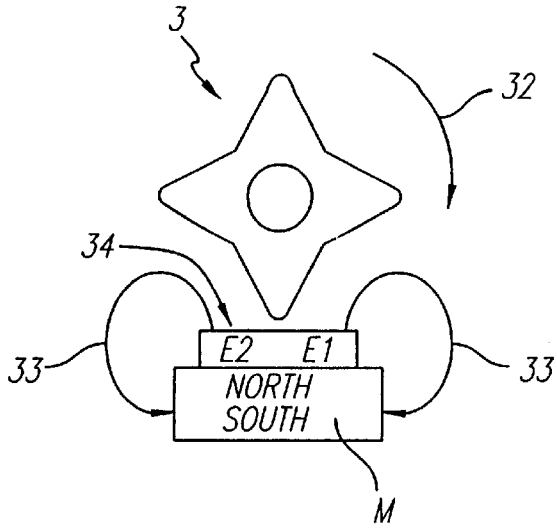
FIGS. 14A and 14B are similar to FIGS. 8A and 8B, except that the sensor/magnet arrangement is offset to the left relative to the peak of the adjacent lobe.
Figure 14B:
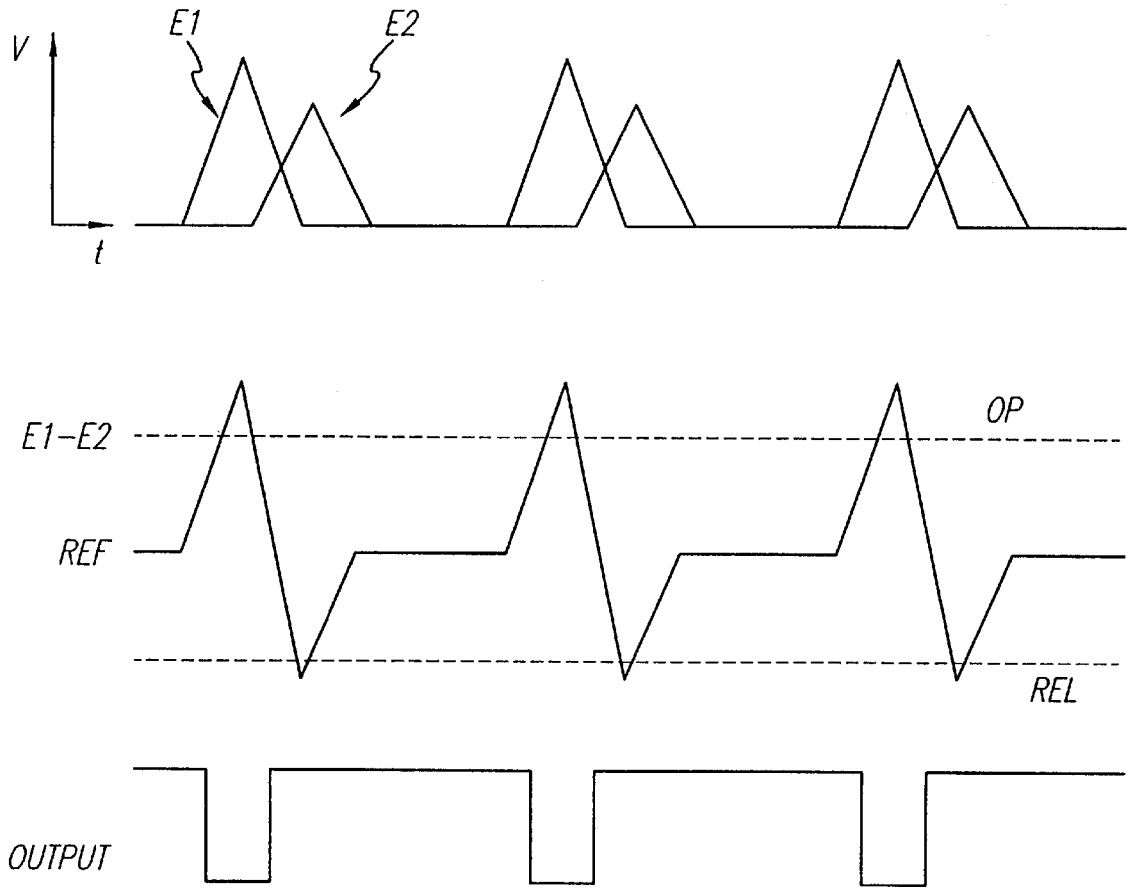

FIGS. 14A and 14B are similar to FIGS. 8A and 8B, except that the sensor/magnet arrangement is offset to the left relative to the peak of the lobe. Since the distance between the lobe and the respective sensor E1 and E2 are different because of the offset of the sensor/magnet structure to the left in 14A, the output of sensor E1 will have a greater amplitude than the output of sensor E2. Moreover, the output of sensor E1 will reach its peak earlier than when the sensor/magnet structure is symmetrically positioned about a line passing through the axis of the camshaft and the lobe adjacent the sensors. As a result, the falling edge of the output pulse will occur earlier than the symmetrical configuration, while the rising edge of the output pulse will be delayed both by the time delay of the peak of the E2 output waveform and by the fact that it is of a lower amplitude and thus crosses the lower release threshold REL at a later point in time. Under these conditions, the spark generation time period is decreased, and the dwell time period is increased from the FIG. 8A arrangement.

Figure 15A:
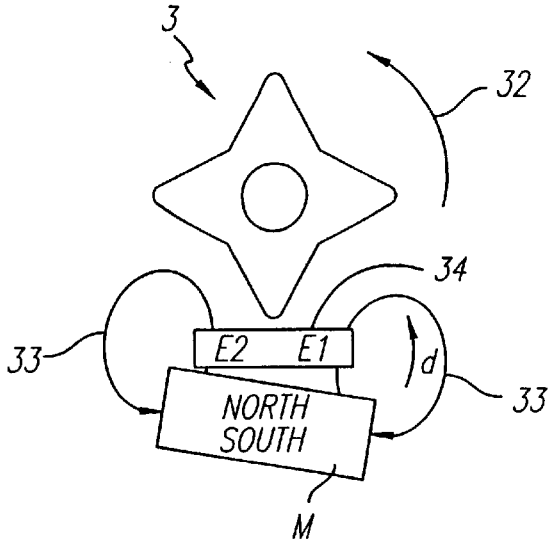
FIGS. 15A and 15B are similar to FIGS. 13A and 13B, except that the back biasing magnet is at an angle relative to the surface of the sensors.
Figure 15B:
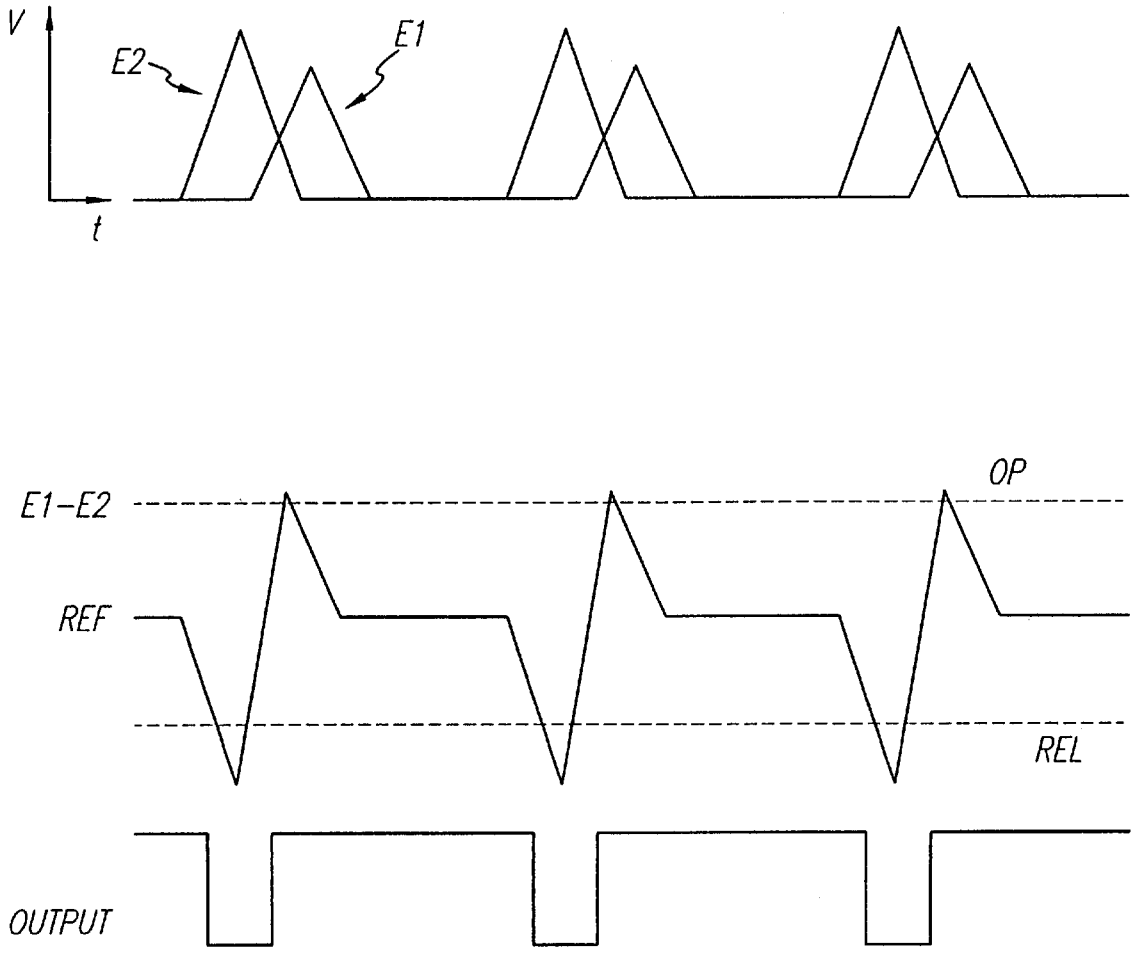

FIGS. 15A and 15B are similar to FIGS. 13A and 13B, except that the back biasing magnet is at an angle relative to the surface of the sensors. Due to the reversal in direction of the camshaft 3, the E2 output pulse precedes the E1 output pulse, and is larger than the E1 output pulse, and thus the analysis of the waveforms of FIG. 15B will be the same, but the inverse of, the waveforms shown in FIG. 13B.

Figure 16A:
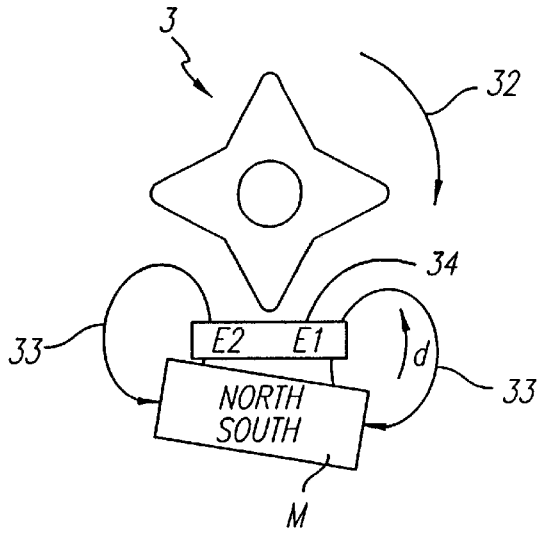
FIGS. 16A and 16B are similar to FIGS. 12A and 12B, except that the polarity of the magnetic field is reversed.
Figure 16B:
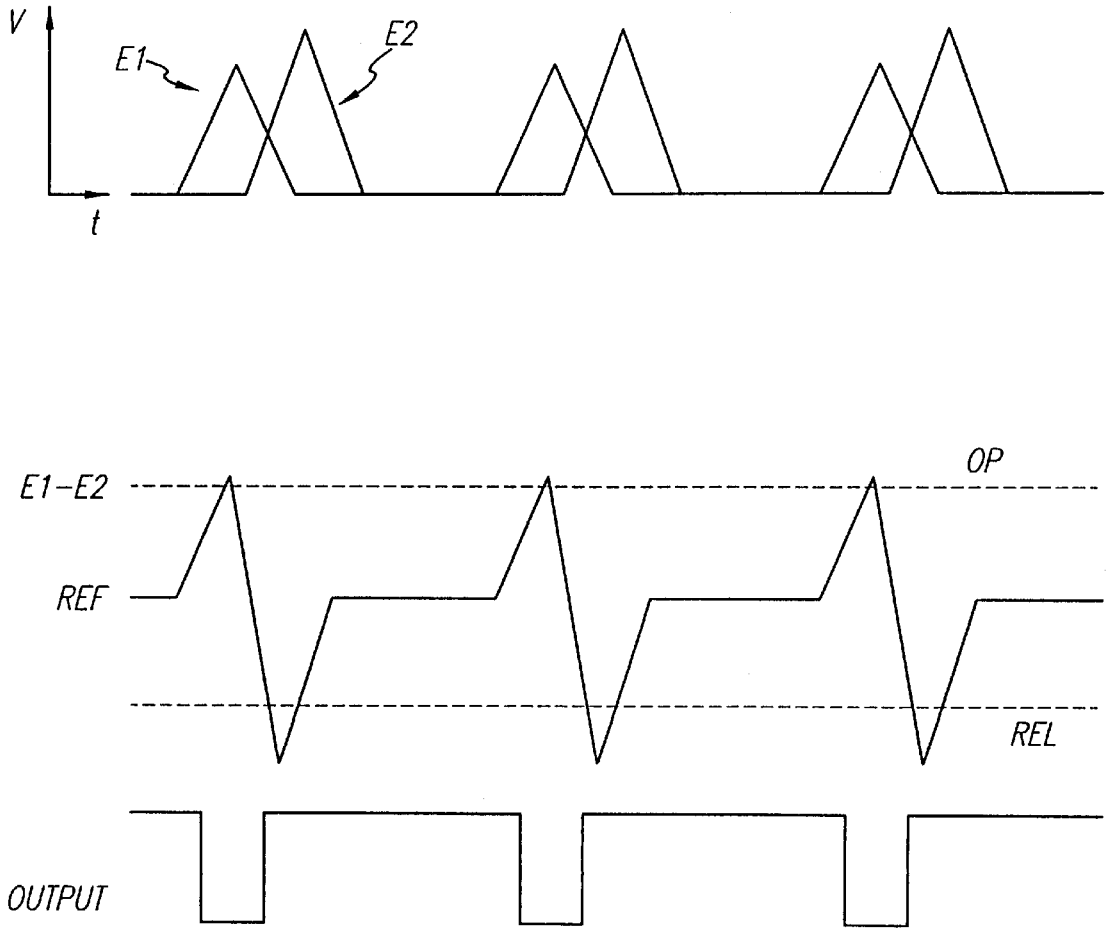

FIGS. 16A and 16B are similar to FIGS. 12A and 12B, except that the polarity of the magnetic field is reversed. Here, the output voltages from output sensors E1 and E2 are positive going, the operate threshold OP is reached later due to the smaller amplitude of the E1 output, while the release threshold REL is reached sooner due to the higher amplitude of the E2 output, the output pulse being substantially the inverse of the output pulse shown in FIG. 12B.

Figure 17A:
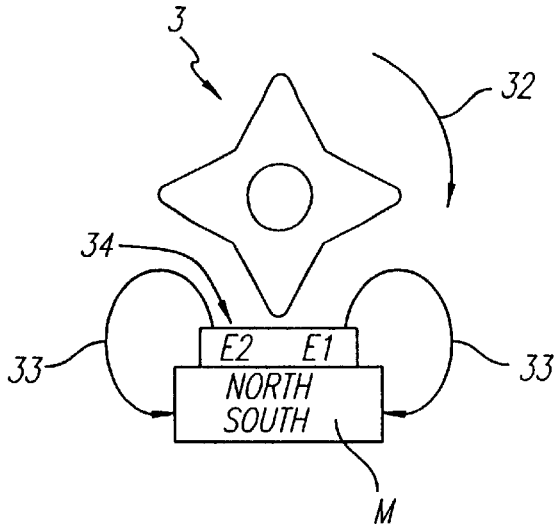
FIGS. 17A and 17B are similar to FIGS. 14A and 14B, except that the sensor/magnet arrangement is offset to the right relative to the peak of the adjacent lobe.
Figure 17B:
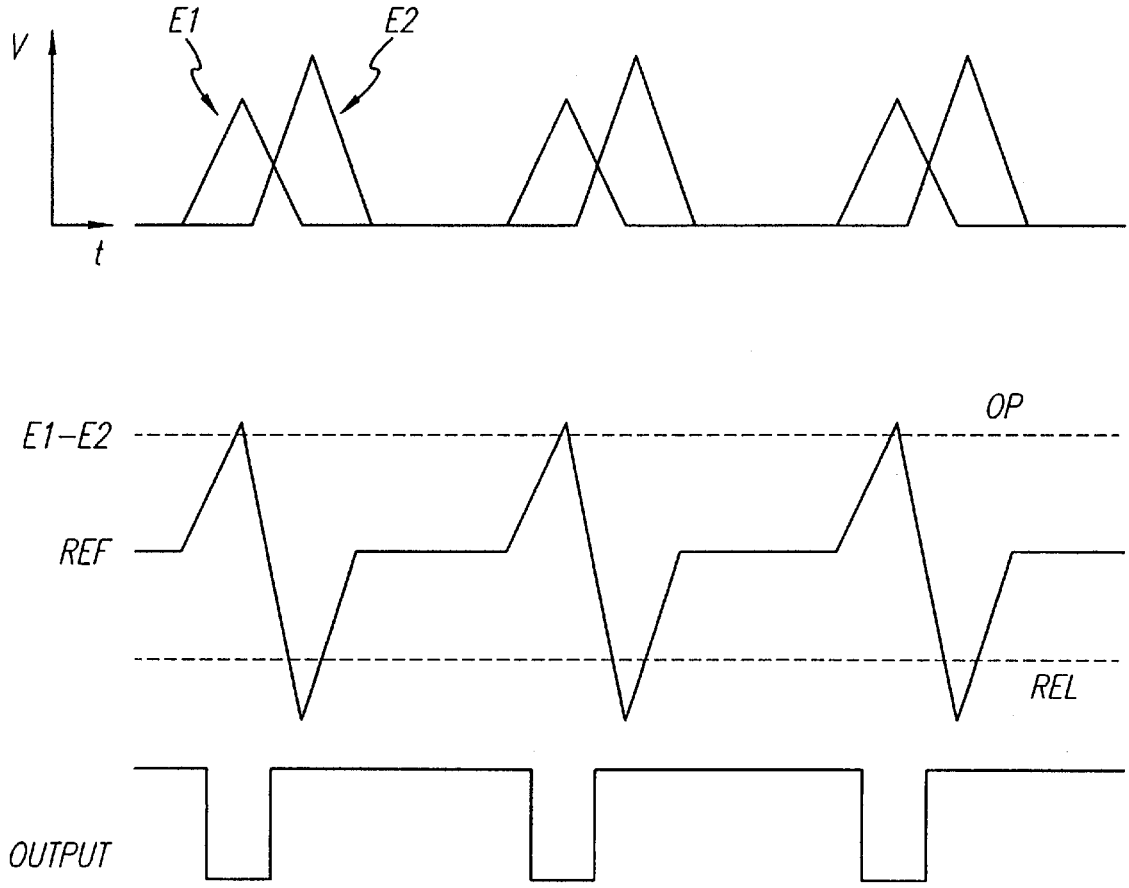

FIGS. 17A and 17B are similar to FIGS. 14A and 14B, except that the sensor/magnet arrangement is offset to the right relative to the peak of the lobe. Due to the shift of the sensor/magnet structure to the right in FIG. 17A, the output from sensor E2 will occur later, but stronger than the output of sensor E1. As a result, the operate threshold OP will be reached later, and the release threshold REL will be reached sooner, thus producing an output pulse similar to that shown in FIG. 14B, but much narrower in width. As compared to the output in FIG. 14B, the output in FIG. 17B shows a shift in the timing as well as a decrease in the dwell time.

Figure 18A:
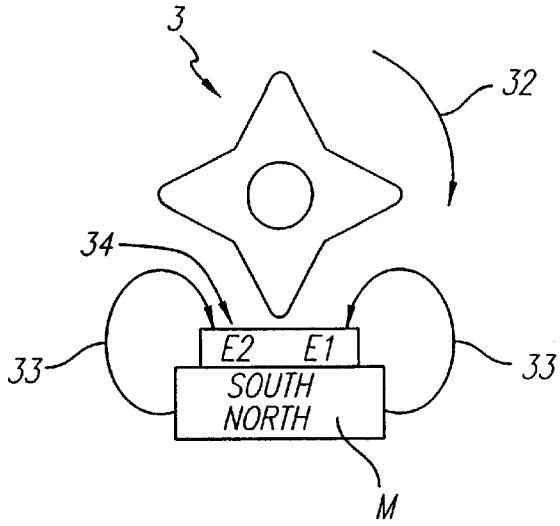
FIGS. 18A and 18B are similar to FIGS. 14A and 14B, except that the polarity of the magnetic field is reversed.
Figure 18B:
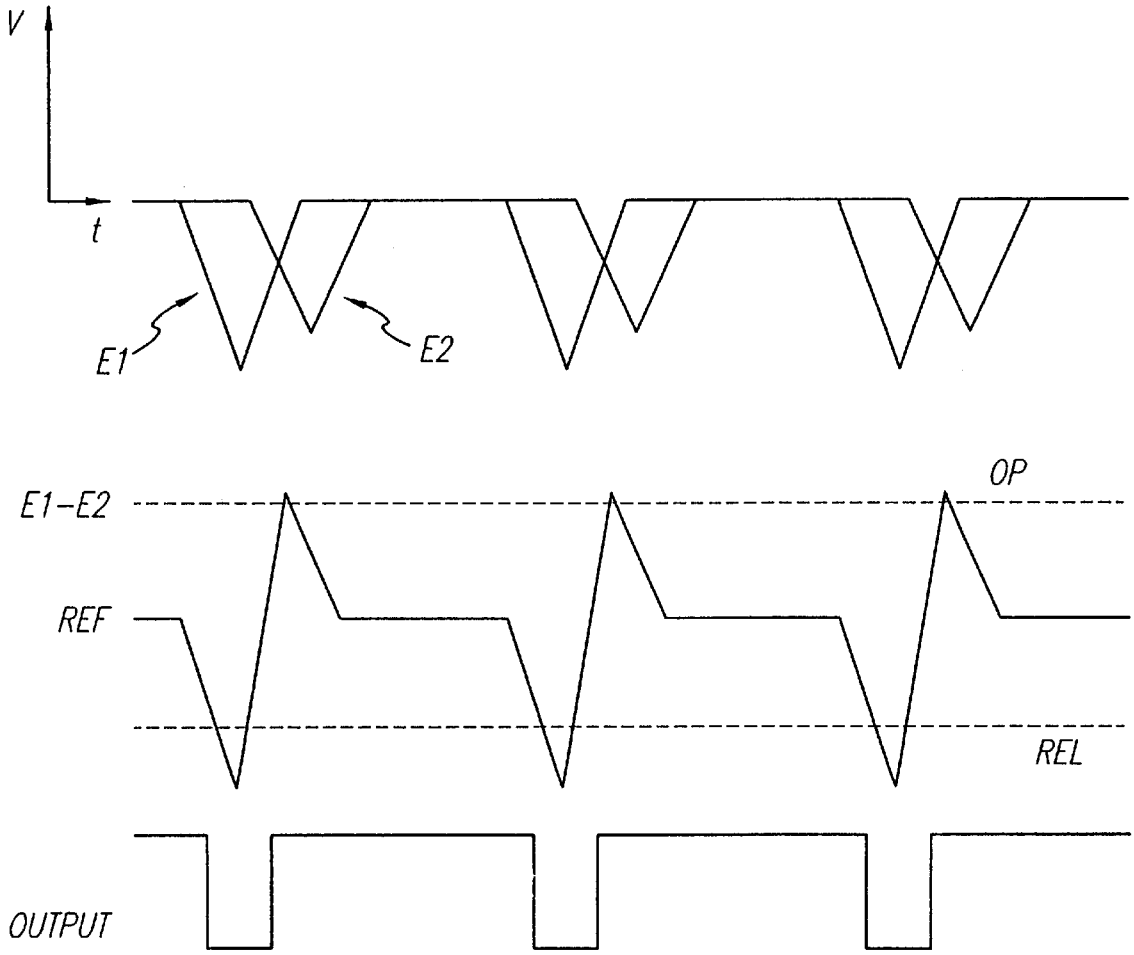

FIGS. 18A and 18B are similar to FIGS. 14A and 14B, except that the polarity of the magnetic field is reversed. Because of the reversal of the magnetic flux lines 33, the sensor outputs E1 and E2 are both negative going. As a result, the difference signal reaches the release threshold level REL sooner and the operate threshold OP later. This time relationship produces an output pulse in which the rising edge occurs sooner, and the falling edge occurs later, thereby shifting the timing and decreasing the dwell time from a symmetrical configuration.

Figure 19B:
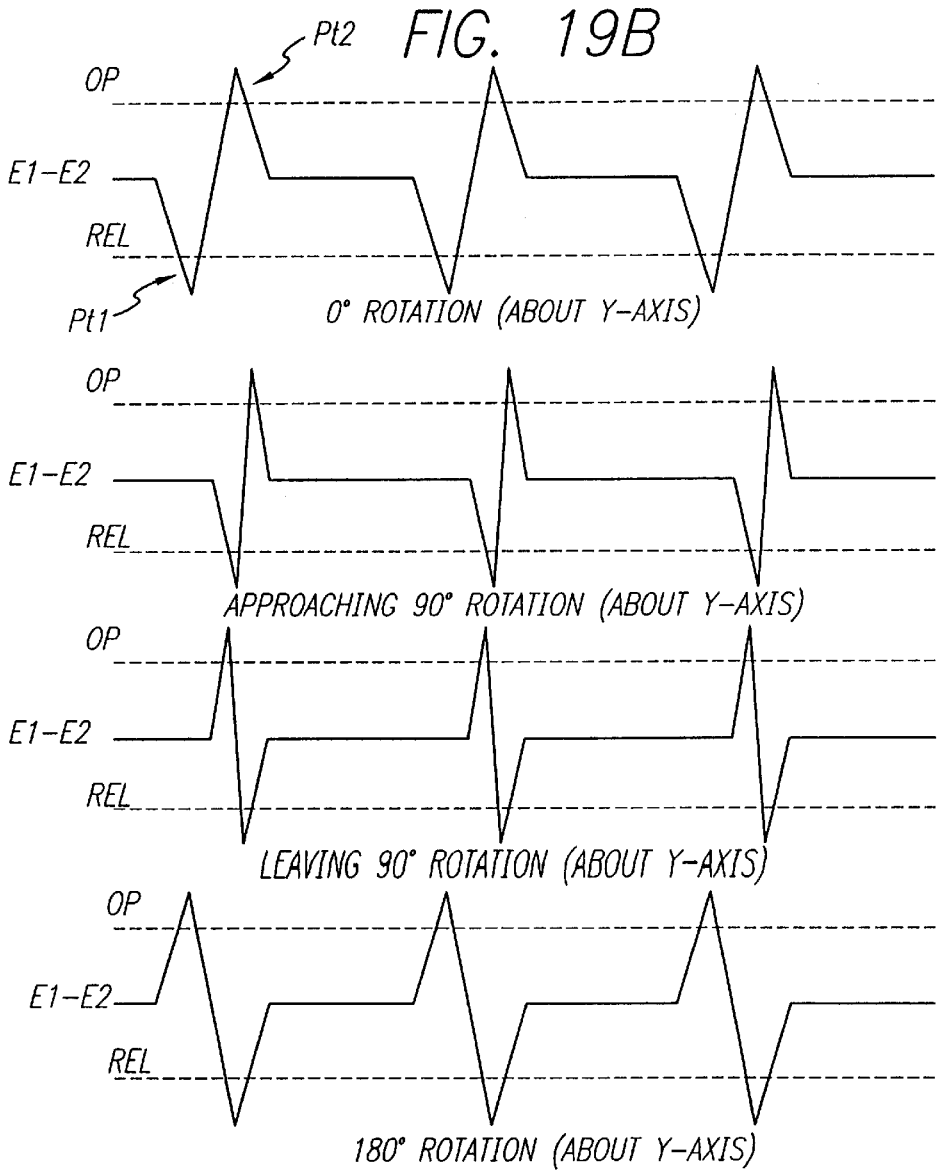

FIGS. 19A and 19B are similar to FIGS. 10A and 10B, except that the plane containing the sensors E1, E2 and magnet M (aligned along the noted x-axis) is tilted about a line (y-axis) passing through the distributor camshaft axis (parallel to the z-axis) and the apex of the lobe facing the sensors, the waveforms showing different angular attitudes of the Hall-effect sensing element. The waveforms shown in FIG. 19B do not show the output pulse resulting from the difference signals illustrated. However, from previous descriptions of the relationship between the difference signal and the two threshold levels, the output pulse waveform can be readily anticipated.

It is to be understood from FIG. 19A that either the sensor block 34 may be rotated about the Y axis relative to the magnet M and the distributor camshaft 3, or the sensor block 34 and magnet M structure may be rotated together about the Y axis to produce different combinations of difference signals and output signals depending upon the desired output.

In the waveforms of FIG. 19B, four of virtually an unlimited number of possibilities are illustrated. In this connection, the direction of rotation of the camshaft 3, the direction of the magnetic flux lines 33, and the North-South orientation of the magnet M are the same as those shown in FIG. 10A. Accordingly, the waveforms of FIG. 10B are representative of the outputs from sensors E1 and E2, as well as the difference signal E1–E2 and the output pulse itself. For example, when there is no rotation about the Y axis, i.e. as illustrated by the top waveform of FIG. 19B, the result is identical to that shown in the middle waveform of FIG. 10B.

As the sensor block and/or magnet structure M is rotated about the Y axis, it will be appreciated that at precisely 90° of rotation, there would be a theoretical cancellation of the two sensor outputs in the difference signal E1–E2. Thus, as the rotation of the sensor block 34 approaches 90°, the widths of both the negative going and positive going portions of the difference signal E1–E2 become smaller, thereby producing a very short positive going output pulse. As the sensor block 34 is rotated beyond a 90° angle, a similar width of output pulses generated, but in the reverse direction. Accordingly, the output pulse generated by the difference signal with the sensor block 34 leading 90° rotation produces a very narrow negative going pulse at the output.

Finally, when the sensor block 34 is rotated 180°, the effect is the same as a zero degree rotation, but with an inversion of the difference signal E1–E2. The resulting waveform is identical to that shown in FIG. 11B. That is, a 180° rotation of the sensor block 34 is equivalent to reversing the direction of rotation of the camshaft 3.

As can be appreciated, the number of ways that the magnet structure, the sensor block, the direction of the magnetic lines of force, the rotational direction of the camshaft, the inversion, or not, of the generated Schmidt trigger "output", and the attitude of the sensor block produce a nearly limitless number of possibilities for the production of an output waveform which will control the firing of the spark plugs and produce substantially any desirable change of timing and dwell time. It will be understood that, while not all of the combinations of these physical variations of the lobe sensor arrangement have been illustrated and described herein, combinations of physical parameters not shown and described are possible and implementation would well within the ordinary skill of a worker in the art without exhausting all of the myriad of possibilities. Accordingly, the invention is not to be limited to the specific variations shown and described herein, but rather would include all combinations of all possible mechanical, electrical, and magnetic variations.

While only certain embodiments of the invention have been set forth above, alternative embodiments and various modifications will be apparent from the above description and the accompanying drawing to those skilled in the art. For example, to achieve greater stability and more precise operation, the Hall-effect module 10 may have built-in preamplifiers to boost the outputs on lines 2 and 4. Alternatively, separate, or additional, preamplifiers may be provided between the outputs of module 10 and the inputs to differential amplifier 7. These and other alternatives are considered equivalents and within the spirit and scope of the present invention.

What is claimed is:

1. A lobe sensor arrangement for an ignition system providing a control signal to an ignition coil of an internal combustion engine to effect sequential firing of spark plugs, the lobe sensor ignition system including a distributor camshaft having a plurality of alternate circumferentially spaced lobes and valleys, said lobe sensor arrangement comprising:

a first sensor for sensing the presence of a camshaft lobe proximate said first sensor, and providing a first sensor output signal representing the proximity of the camshaft lobe relative to said first sensor;

a second sensor, circumferentially spaced from said first sensor, for sensing the presence of a camshaft lobe proximate said second sensor, and providing a second sensor output signal representing the proximity of the camshaft lobe relative to said second sensor;

a comparator circuit for comparing said first sensor output signal with said second sensor output signal, and producing a system output signal comprising a series of system output pulses generated upon the occurrence of said first and second sensor output signals having values meeting relative predetermined criteria; and an amplifier for generating said control signal responsive to said system output signal.

2. The lobe sensor arrangement as claimed in claim 1, wherein:

said first and second sensors comprise Hall-effect sensors and a back biasing magnet structure, said magnet structure providing a source of magnetic flux for each sensor, and said Hall-effect sensors sensing a change in said magnetic flux when disturbed by the passing by of a camshaft lobe.

3. The lobe sensor arrangement as claimed in claim 1, wherein:

said Hall-effect sensors are contained in a housing having a surface facing the distributor camshaft;

said Hall-effect sensors lie substantially at said housing surface;

the camshaft has an axis parallel to said housing surface; and the lobes and valleys rotate in a plane perpendicular to said housing surface.

4. The lobe sensor arrangement as claimed in claim 3, wherein said housing surface is planar, and said Hall-effect sensors are arranged in a coplanar array at said housing surface.

5. The lobe sensor arrangement as claimed in claim 3, wherein said surface is curvilinear, and said Hall-effect sensors are arranged in a curvilinear array at said housing surface.

6. The lobe sensor arrangement as claimed in claim 1, wherein said relative predetermined criteria include the magnitude of said first sensor output signal being equal to the magnitude of said second sensor output signal.

7. The lobe sensor arrangement as claimed in claim 6, wherein said relative predetermined criteria include the magnitude of both said first and second sensor output signals being greater than a predetermined threshold value.

8. The lobe sensor arrangement as claimed in claim 2, wherein said magnet structure is positioned on a side of said Hall-effect sensor opposite said housing surface, to provide back bias for said Hall-effect sensor, whereby the passing of a camshaft lobe adjacent the surface side of said Hall-effect sensor disturbs the magnetic flux produced by said magnet structure sufficiently to induce an output from said sensor.

9. The lobe sensor arrangement as claimed in claim 4, wherein:

each lobe extends radially outwardly from the distributor camshaft terminating in a narrow apex; and said sensors are spaced equally from respective sides of a plane passing through the camshaft axis; whereby a trigger pulse is produced when each lobe apex is adjacent said sensors and normal to said housing surface.

10. The lobe sensor arrangement as claimed in claim 1, wherein:

said Hall-effect sensors are arranged to lie in a first plane facing the distributor camshaft;

the camshaft has an axis parallel to said first plane; and the lobes and valleys rotate in a second plane perpendicular to said first plane.

11. The lobe sensor arrangement as claimed in claim 10, wherein:

each lobe extends radially outwardly from the distributor camshaft terminating in a narrow apex; and said sensors are spaced equally from respective sides of a third plane passing through the camshaft axis; whereby a system output pulse is produced when each lobe apex is adjacent said sensors and normal to said first plane.

12. The lobe sensor arrangement as claimed in claim 1, wherein:

the camshaft has an axis, and said sensors are arranged in a curvilinear array equidistant from the camshaft axis; and the lobes and valleys rotate in a plane perpendicular to the camshaft axis.

13. The lobe sensor arrangement as claimed in claim 12, wherein:

each lobe extends radially outwardly from the distributor camshaft terminating in a narrow apex; and said sensors are spaced equally from respective sides of a second plane passing through the camshaft axis; whereby a system output pulse is produced when each lobe apex is adjacent said sensors and lies in said second plane.

14. A lobe sensor arrangement for use in an ignition system which comprises a distributor camshaft having an axis and a plurality of alternately spaced lobes and valleys circumferentially spaced about the axis, each lobe in a first predetermined spacing and each lobe terminating in a narrow apex, said lobe sensor arrangement providing a control signal to an ignition coil of an internal combustion engine to effect sequential firing of spark plugs, said lobe sensor arrangement comprising:

first and second sensors in close proximity to each other in a second predetermined spacing substantially less than said first predetermine spacing and facing the camshaft, each said sensor producing an electrical sensor output representative of the event of the same lobe passing by; and a pulse generator coupled to the outputs of said sensors and producing said control signal developed by processing said sensor outputs.

15. A lobe sensor arrangement for use in an ignition system which comprises a distributor camshaft having an axis and a plurality of alternately spaced lobes and valleys circumferentially spaced about the axis, each lobe terminating in a narrow apex, said lobe sensor arrangement providing a control signal to an ignition coil of an internal combustion engine to effect sequential firing of spark plugs, said lobe sensor arrangement comprising:

first and second sensors facing the camshaft, each said sensor producing an electrical sensor output representative of the event of a lobe passing by; and a pulse generator coupled to the outputs of said sensors and producing said control signal developed by processing said sensor outputs;

said first and second sensors are defined by a structure comprising first and second Hall-effect sensors and a back biasing magnet, said magnet providing a source of magnetic flux for each sensor, and said Hall-effect sensors sensing a change in said magnetic flux when disturbed by the passing of a distributor shaft lobe.

16. The lobe sensor arrangement as claimed in claim 15, wherein:

changing the North/South orientation of the magnetic poles of said back biasing magnet relative to said Hall-effect sensors changes dwell and timing of the ignition system.

17. The lobe sensor arrangement as claimed in claim 15, wherein:

changing the angular relationship between said back biasing magnet and said sensors changes dwell and timing of the ignition system.

18. The lobe sensor arrangement as claimed in claim 15, wherein:

changing orientation of a plane containing said sensors about a line passing through said plane and perpendicular to the camshaft axis, changes dwell and timing of the ignition system.

19. The lobe sensor arrangement as claimed in claim 15, wherein:

changing the symmetry of said sensors relative to a line perpendicular to the camshaft axis and passing through a lobe apex facing said sensors, changes dwell and timing of the ignition system.

20. A lobe sensor arrangement for use in an ignition system which comprises a distributor camshaft having an axis and a plurality of alternately spaced lobes and valleys circumferentially spaced about the axis, each lobe terminating in a narrow apex, said lobe sensor arrangement providing a control signal to an ignition coil of an internal combustion engine to effect sequential firing of spark plugs, said lobe sensor arrangement comprising:

first and second sensors facing the camshaft, each said sensor producing an electrical sensor output representative of the event of a lobe passing by; and a pulse generator coupled to the outputs of said sensors and producing said control signal developed by processing said sensor outputs;

said control signal is a rectangular wave defined by first and second voltage levels;

said pulse generator causes current to flow in the engine ignition coil during the time said control signal is at said first level; and said pulse generator interrupts current flowing in the engine ignition coil during the time said control signal is at said second level.

21. The lobe sensor arrangement as claimed in claim 20, wherein said pulse generator comprises:

a sensor signal processor receiving said sensor outputs and producing a composite sensor signal; and a threshold detector having an operate threshold and a release threshold, said composite sensor signal having portions extending beyond said operate threshold and other portions extending beyond said release threshold; whereby said control signal transitions from said second voltage level to said first voltage level when said composite sensor signal exceeds said operate threshold, and said control signal transitions from said first voltage level to said second voltage level when said composite sensor signal exceeds said release threshold.

22. The lobe sensor arrangement as claimed in claim 21, wherein:

said sensor signal processor comprises a differential amplifier;

said composite sensor signal is the output of said differential amplifier and represents the difference between said first and second sensor outputs;

said operate threshold is a prescribed positive voltage level;

said release threshold is a prescribed negative voltage level; and said control signal first level duration is determined from the time said composite sensor signal transitions positively to above said operate threshold to the time said composite sensor signal transitions negatively to below said release threshold.

23. The lobe sensor arrangement as claimed in claim 20, wherein:

the time duration of said control signal at said first voltage level defines an ignition coil current-building, magnetic field building, time;

the time duration of said control signal at said second voltage level defines a dwell time for the ignition system; and a spark is generated by the collapsing of the ignition coil magnetic field at the transition from said first voltage level to said second voltage level.

24. A method for adjusting the timing and dwell in an ignition system which comprises a distributor camshaft having an axis and a plurality of alternately spaced lobes and valleys circumferentially spaced about the axis, each lobe terminating in a narrow apex, said method comprising:

providing a lobe sensor arrangement comprising first and second Hall-effect sensors and a back biasing magnet having North and South poles creating a magnetic field;

orienting said sensors to face the camshaft and to lie within said magnetic field, each sensor producing an electrical sensor output representative of the event of a lobe passing by and disturbing said magnetic field; and processing said electrical sensor outputs to generate a control signal having first and second states, and applying said control signal to an ignition coil of an internal combustion engine to establish timing of the sequential firing of spark plugs, one of said first and second states defining ignition system dwell.

25. The method as claimed in claim 24, comprising:

changing the North/South orientation of the magnetic poles of said back biasing magnet relative to said Hall-effect sensors to effect related changes in dwell and timing of the ignition system.

26. The method as claimed in claim 24, comprising:

changing the angular relationship between said back biasing magnet and said sensors to effect related changes in dwell and timing of the ignition system.

27. The method as claimed in claim 24, comprising:

changing the orientation of a plane containing said sensors about a line passing through said plane and perpendicular to the camshaft axis to effect related changes in dwell and timing of the ignition system.

28. The method as claimed in claim 24, comprising:

changing the symmetry of said sensors relative to a line perpendicular to the camshaft axis and passing through a lobe apex facing said sensors to effect related changes in dwell and timing of the ignition system.

29. The method as claimed in claim 24, wherein said processing step comprises:

receiving said sensor outputs and producing a composite sensor signal establishing an operate threshold and a release threshold, said composite sensor signal having portions extending beyond said operate threshold and other portions extending beyond said release threshold; and causing said control signal to transition from said second state to said first state when said composite sensor signal exceeds an operate threshold, and causing said control signal to transition from said first state to said second state when said composite sensor signal exceeds a release threshold.

30. The method as claimed in claim 29, wherein said processing step comprises:

performing a difference function whereby said composite sensor signal represents the difference between said first and second sensor outputs, said operate threshold being a prescribed positive voltage level, and said release threshold being a prescribed negative voltage level; and wherein said control signal first state is determined from the time said composite sensor signal transitions positively to above said operate threshold to the time said composite sensor signal transitions negatively to below said release threshold.

31. The method as claimed in claim 24, wherein:

the time duration of said control signal at said first state defines an ignition coil current-building, magnetic field building, time;

the time duration of said control signal at said second state defines a dwell time for the ignition system; and a spark is generated by the collapsing of the ignition coil magnetic field at the transition from said first state to said second state.

32. The method as claimed in claim 24, wherein said processing step comprises:

receiving said sensor outputs and comparing said first sensor output with said second sensor output; and causing said control signal to transition from said first state to said second state when said comparing step determines said first sensor output signal equals said second sensor output signal, and causing said control signal to transition from said second state to said first state when said second sensor output signal falls below a prescribed release threshold.

33. The method as claimed in claim 32, wherein:

the time duration of said control signal at said first state defines an ignition coil current-building, magnetic field building time;

the time duration of said control signal at said second state defines a spark generation time; and a spark is generated by the collapsing of the ignition coil magnetic field at the transition from said first state to said second state.

* * * * *